US006320542B1

(12) United States Patent
Yamamoto et al.

(10) Patent No.: US 6,320,542 B1
(45) **Date of Patent: *Nov. 20, 2001**

(54) PATCH ANTENNA APPARATUS WITH IMPROVED PROJECTION AREA

(75) Inventors: Atsushi Yamamoto; Toshimitsu Matsuyoshi; Koichi Ogawa, all of Osaka (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/400,981

(22) Filed: Sep. 22, 1999

(30) Foreign Application Priority Data

Sep. 22, 1998 (JP) ..... 10-267888
Feb. 26, 1999 (JP) ..... 11-49988

(51) Int. Cl.[7] ..... H01Q 1/38
(52) U.S. Cl. ..... 343/700 MS; 343/824
(58) Field of Search ..... 343/700 MS, 824, 343/876; 342/374, 354

(56) References Cited

U.S. PATENT DOCUMENTS 5,010,349 * 4/1991 Mizuno et al. ..... 343/700 MS
5,223,848 * 6/1993 Rammos et al. ..... 343/700 MS
5,486,836 * 1/1996 Kuffner et al. ..... 343/700 MS
5,717,407 2/1998 Hong ..... 343/700 MS
5,952,971 * 9/1999 Strickland ..... 343/700 MS
5,995,048 * 11/1999 Smithgall et al. ..... 343/700 MS
6,002,370 * 8/1998 Mckinnon et al. ..... 343/700 MS

FOREIGN PATENT DOCUMENTS 5-114818 5/1993 (JP) .

* cited by examiner

*Primary Examiner*—Don Wong
*Assistant Examiner*—James Clinger
(74) *Attorney, Agent, or Firm*—Wenderoth, Lind & Ponack, L.L.P.

(57) ABSTRACT

A patch antenna apparatus with a simple structure can obtain an improved desired projection area in accordance with a projection space. The patch has a dielectric substrate with a grounding conductor on its bottom surface. On the dielectric substrate is formed at least one conductor patch having a first feeding point for producing resonance in parallel to the X-axis at a predetermined resonance frequency and a second feeding point for producing resonance in parallel to the Y-axis at the resonance frequency. A controller for a power distributing and combining circuit controls each of radio signals of the resonance frequency fed to the first and second feeding points so as to change at least one of the amplitude and phase thereof. When the radio signals of the resonance frequency are fed to the first and second feeding points, the patch antenna apparatus projects radio waves including two linear polarizations which are parallel to the X and Y axes and which cross each other to be perpendicular to each other in a projection directional pattern corresponding to the control for the radio signals by the controller of the power distributing and combining circuit.

24 Claims, 28 Drawing Sheets

FIRST PREFERRED EMBODIMENT

SECOND PREFERRED EMBODIMENT

THIRD PREFERRED EMBODIMENT

FOURTH PREFERRED EMBODIMENT

FIFTH PREFERRED EMBODIMENT

SIXTH PREFERRED EMBODIMENT

SEVENTH PREFERRED EMBODIMENT

EIGHTH PREFERRED EMBODIMENT

NINTH PREFERRED EMBODIMENT

TENTH PREFERRED EMBODIMENT

ELEVENTH PREFERRED EMBODIMENT

TWELFTH PREFERRED EMBODIMENT

FIRST MODIFIED PREFERRED EMBODIMENT

SECOND MODIFIED PREFERRED EMBODIMENT

FIRST PREFERRED EXAMPLE

POWER DISTRIBUTING AND COMBINING CIRCUIT 34

FIRST PREFERRED EXAMPLE

FIRST PREFERRED EXAMPLE

FIRST PREFERRED EXAMPLE

SECOND PREFERRED EXAMPLE

SECOND PREFERRED EXAMPLE

SECOND PREFERRED EXAMPLE

SECOND PREFERRED EXAMPLE

PATCH ANTENNA APPARATUS WITH IMPROVED PROJECTION AREA

BACKGROUND OF THE INVENTION

1. Field of the Invention

The present invention relates to a patch antenna apparatus, and more particularly, a patch antenna apparatus mainly for use in an antenna apparatus for a base station of mobile communication systems.

2. Description of the Prior Art

FIG. 29 is a perspective view showing a configuration of a prior art patch antenna apparatus. FIGS. 30 to 32 are pattern diagrams each showing an example of the projection directional pattern of the patch antenna apparatus of FIG. 29.

Referring to FIG. 29, a dielectric substrate 90 has a top surface and a bottom surface which are parallel to each other, and a grounding conductor 91 is formed on the bottom surface of the dielectric substrate 90. On the top surface of the dielectric substrate 90 is formed a square-shaped conductor patch 92 having a square which has one side having a length of half a wavelength of a resonance frequency when the dielectric constant of the dielectric substrate 90 is taken into consideration. For example, the conductor patch 92 is formed so that, on an X-Y plane having the origin located in the center of the dielectric substrate 90, sides of the square of the conductor patch 92 which cross each other so as to be perpendicular to each other are parallel to the X-axis and Y-axis, respectively, and the center of the conductor patch 92 is positioned at the origin of the X-Y plane. Further, a feeding point 93 is positioned on the X-axis, namely, is located on the perpendicular bisector of one side in the Y-axis direction of the square of the conductor patch 92. When a radio signal having the above-mentioned resonance frequency is fed to the feeding point 93, the patch antenna apparatus resonates in parallel with the X-axis. Consequently, the radio signal is projected, as a linearly polarized radio wave having the exciting or driving direction parallel to the X-axis including the feeding point 93, in the Z-axis direction which is perpendicular to the X-Y plane and opposite to the grounding conductor 91.

As shown in FIGS. 30 to 32, the radio wave projected from the patch antenna apparatus of FIG. 29 has a main polarization which is a linear polarization having the exciting or driving direction parallel to the X-axis. The radio wave is projected so that its projection intensity becomes the maximum in the Z direction which is the front direction of the patch antenna apparatus.

However, the prior art patch antenna apparatus shown in FIG. 29 can project the linearly polarized radio wave which is parallel to the X-axis but cannot project a linear polarization parallel to the Y-axis which is perpendicular to the X-axis. Although the patch antenna apparatus can strongly project the radio wave in the Z direction which is the front direction of the antenna apparatus, the patch antenna apparatus cannot strongly project the radio wave in the horizontal direction of the antenna apparatus and an upper direction inclined with a low elevation angle.

For example, in the case of projecting the radio wave in a space such as a room or the like whose height is small and which has a broadening in the horizontal direction, it can be considered that the antenna apparatus is provided on a ceiling or a wall surface. In consideration of the view or the like, however, it is desirable to install the antenna apparatus on the ceiling which is not usually seen. In the case of suspending the antenna apparatus from the ceiling, in order to efficiently project the radio wave, it is preferable to horizontally suspend the antenna apparatus from the ceiling so that the plane of the dielectric substrate 90 is parallel to the surface of the ceiling (hereinafter, this installing method will be referred to as a ceiling installing method). In this case, the radio wave projected from the patch antenna apparatus has only a polarization which is parallel with the X-axis. Mainly, a vertical polarized radio wave is used in mobile communication systems. In the ceiling installing method, however, the intensity of the vertical polarized radio wave in radio waves projected from the antenna apparatus is the strongest on the X-axis and no vertical polarized radio wave exists in radio waves projected from the antenna apparatus on the Y-axis.

In the case of a space such as a room or the like whose height is small and which has a broadening in the horizontal direction, in order to realize a broader projection area, it is desirable that the radio wave is strongly projected from the antenna apparatus in the horizontal direction of the antenna apparatus and an upper direction inclined with a low elevation angle.

SUMMARY OF THE INVENTION

A first object of the present invention is to provide a patch antenna apparatus having a simple structure and being capable of controlling a projection area so as to obtain a desired projection area in accordance with a projection space.

Also, a second object of the present invention is to provide a patch antenna apparatus having a simple structure and being capable of obtaining a projection area broader than that of the prior art.

Further, a third object of the present invention is to provide a patch antenna apparatus having a simple structure and being capable of maximizing projection of the radio wave in the direction with a low elevation angle.

Still further, a fourth object of the present invention is to provide a patch antenna apparatus having a simple structure, having a gain higher than that of the prior art, and being capable of obtaining a projection beam narrower than that of the prior art.

According to the first aspect of the present invention, there is provided a patch antenna apparatus comprising:

a dielectric substrate having a first axis and a second axis which cross each other to be perpendicular to each other, and having a first surface and a second surface which are parallel to each other;

a grounding conductor formed on the first surface;

at least one conductor patch formed on the second surface, the conductor patch having a first feeding point for producing resonance in parallel to the first axis at a predetermined resonance frequency, and having a second feeding point for producing resonance in parallel to the second axis at the resonance frequency; and control means for controlling each of radio signals of the resonance frequency fed to the first and second feeding points, so as to change at least one of an amplitude and a phase thereof, thereby, upon feeding the radio signals of the resonance frequency to the first and second feeding points, projecting radio waves having two linear polarizations which are parallel to the first and second axes and which cross each other to be perpendicular to each other, with a projection directional pattern corresponding to the control for the radio signals by the control means.

In the above-mentioned patch antenna apparatus, there is preferably provided at least two of the conductor patches, where two conductor patches selected from the at least two conductor patches are arranged so as to be symmetrical to each other with respect to the first axis, and the control means controls the radio signals so as to feed the radio signals having the same phases to either one of each of the first feeding points and each of the second feeding points of the two conductor patches arranged so as to be symmetrical to each other with respect to the first axis.

Further, in the above-mentioned patch antenna apparatus, there is preferably provided at least four of the conductor patches, where each pair of the conductor patches selected from the at least four conductor patches is arranged so as to be symmetrical to each other with respect to the first axis, and the control means controls the radio signals so as to feed the radio signals having phases opposite to each other to either one of each of the first feeding points and each of the second feeding points of the each pair of the conductor patches arranged so as to be symmetrical to each other with respect to the first axis.

According to the second aspect of the present invention, there is provided a patch antenna apparatus comprising:

a dielectric substrate having a first axis and a second axis which cross each other to be perpendicular to each other, and having a first surface and a second surface which are parallel to each other;

a grounding conductor formed on the first surface;

at least one first conductor patch formed on the second surface, the at least one first conductor patch having a first feeding point for producing resonance in parallel to the first axis at a predetermined resonance frequency;

at least one second conductor patch formed on the second surface, the at least one second conductor patch having a second feeding point for producing resonance in parallel to the second axis at the resonance frequency; and control means for controlling each of the radio signals of the resonance frequency fed to the first and second feeding points, so as to change at least one of an amplitude and a phase thereof, thereby, upon feeding the radio signals of the resonance frequency to the first and second feeding points, projecting radio waves having two linear polarizations which are parallel to the first and second axes and which cross each other to be perpendicular to each other with a projection directional pattern corresponding to the control for the radio signals by the control means.

In the above-mentioned patch antenna apparatus, there is preferably provided at least two of the first conductor patches, where two first conductor patches selected from the at least two conductor patches are arranged so as to be symmetrical to each other with respect to the first axis, and the control means controls the radio signals so as to feed the radio signals of the same phase to each of the first feeding points of the two first conductor patches arranged so as to be symmetrical to each other with respect to the first axis.

In the above-mentioned patch antenna apparatus, there is preferably provided at least two of the second conductor patches, where two second conductor patches selected from the at least two conductor patches are arranged so as to be symmetrical to each other with respect to the first axis, and the control means controls the radio signals so as to feed the radio signals of the same phase to each of the second feeding points of the two second conductor patches arranged so as to be symmetrical to each other with respect to the first axis.

In the above-mentioned patch antenna apparatus, there is preferably provided at least four of the first conductor patches, where each pair of the first conductor patches selected from the at least four first conductor patches is arranged so as to be symmetrical to each other with respect to the first axis, and the control means controls the radio signals so as to feed the radio signals having phases opposite to each of other to each the first feeding point of each pair of the first conductor patches arranged so as to be symmetrical to each other with respect to the first axis.

In the above-mentioned patch antenna apparatus, there is preferably provided at least four of the second conductor patches, where each pair of the second conductor patches selected from the at least four second conductor patches is arranged so as to be symmetrical to each other with respect to the first axis, and the control means controls the radio signals so as to feed the radio signals having phases opposite to each of other to each of the second feeding points of each pair of the second conductor patches arranged so as to be symmetrical to each other with respect to the first axis.

According to the third aspect of the present invention, there is provided a patch antenna apparatus comprising:

a dielectric substrate having a first axis and a second axis which cross each other to be perpendicular to each other, and having a first surface and a second surface which are parallel with each other;

a grounding conductor formed on the first surface;

at least one first conductor patch formed on the second surface, the at least one first conductor patch having a first feeding point for producing resonance in parallel to the first axis at a predetermined resonance frequency, and having a second feeding point for producing resonance in parallel to the second axis at the resonance frequency;

at least one second conductor patch formed on the second surface, the at least one second conductor patch having a third feeding point for producing resonance in parallel to the first axis at the resonance frequency;

at least one third conductor patch formed on the second surface, the at least one third conductor patch having a fourth feeding point for producing resonance in parallel to the second axis at the resonance frequency; and control means for controlling each of the radio signals of the resonance frequency fed to the first to fourth feeding points, so as to change at least one of an amplitude and a phase thereof, thereby, upon feeding the radio signals of the resonance frequency to the first to fourth feeding points, projecting radio waves including two linear polarizations which parallel to the first and second axes and which cross each other to be perpendicular to each other, with a projection directional pattern corresponding to the control for the radio signals by the control means.

In the above-mentioned patch antenna apparatus, a length in the resonance direction of each of the conductor patches is preferably set to a value of integer times of half a wavelength, on the basis of the wavelength when a dielectric constant of the dielectric substrate is taken into consideration.

In the above-mentioned patch antenna apparatus, preferably, one of two resonance ends of each of the conductor patches is electrically connected to the grounding conductor, and a length in the resonance direction of each of the conductor patches is set to a value of integer times of a quarter of wavelength, on the basis of the wavelength when a dielectric constant of the dielectric substrate is taken into consideration.

In the above-mentioned patch antenna apparatus, each of the conductor patches has preferably either a square shape, a rectangular shape, or a circular shape.

BRIEF DESCRIPTION OF THE DRAWINGS

These and other objects and features of the present invention will become clear from the following description taken in conjunction with the present preferred embodiments thereof with reference to the accompanying drawings throughout which like parts are designated by like reference numerals, and in which.

DETAILED DESCRIPTION OF THE PRESENT PREFERRED EMBODIMENTS

Figure 1:
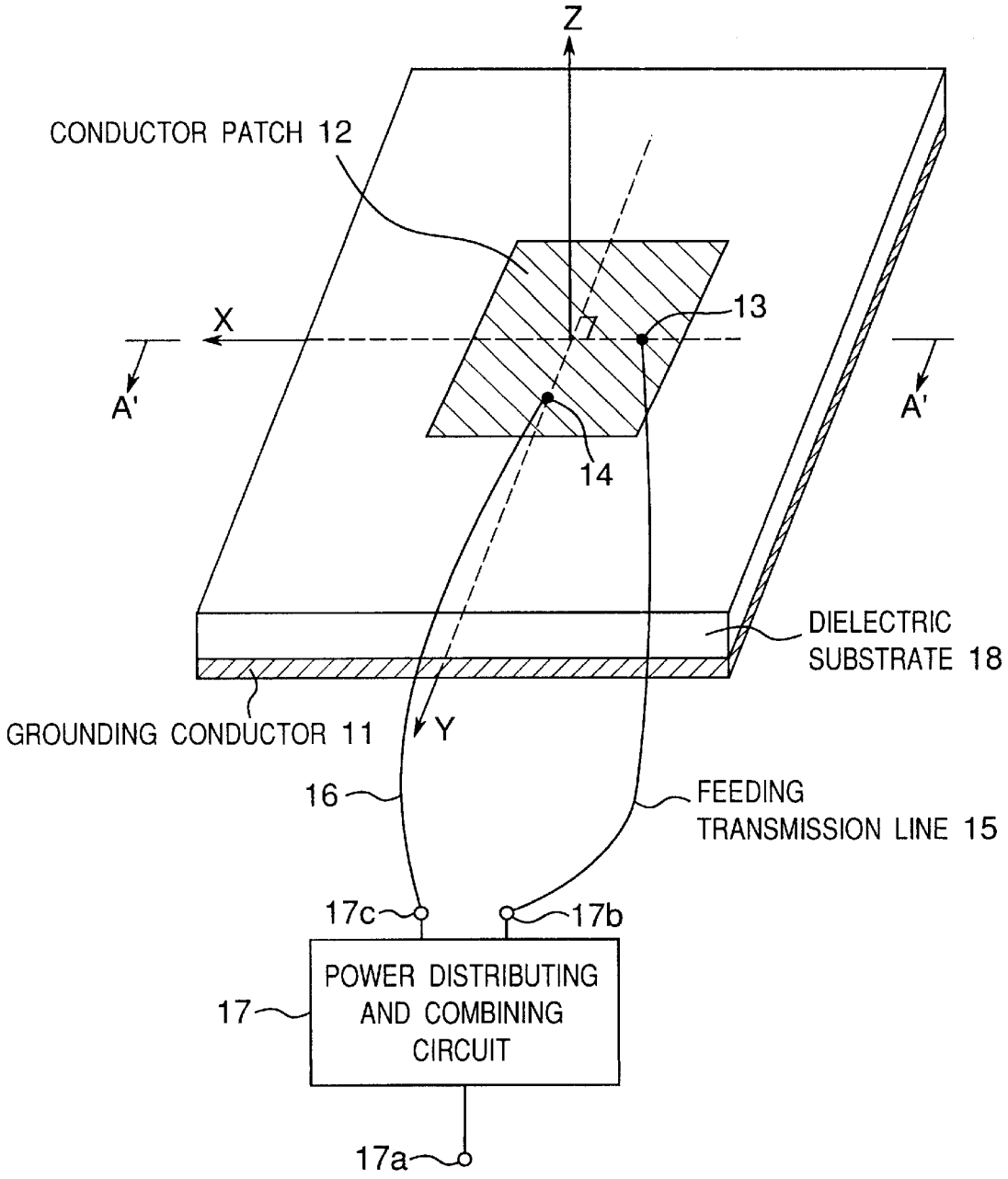
FIG. 1 is a perspective view showing a configuration of a patch antenna apparatus of a first preferred embodiment according to the present invention.

Preferred embodiments according to the present invention will be described below with reference to the attached drawings. It is to be noted that in the drawings, the same reference numerals denote similar components.

FIRST PREFERRED EMBODIMENT

Figure 2:
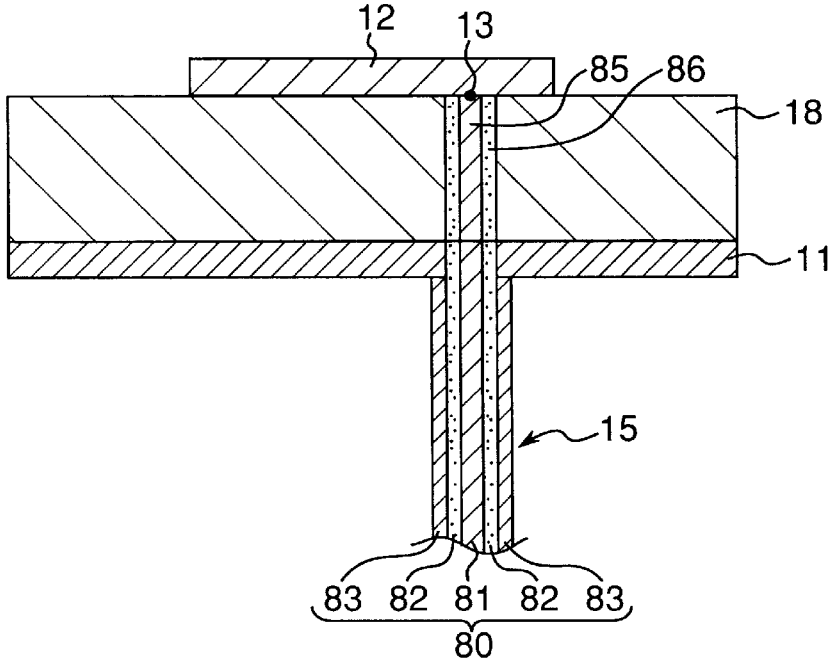
FIG. 2 is a vertical cross sectional view taken along the line A–A' of FIG. 1.

FIG. 1 is a perspective view showing a configuration of a patch antenna apparatus of a first preferred embodiment according to the present invention, and FIG. 2 is a vertical cross sectional view taken along the line A–A' of FIG. 1. The patch antenna apparatus of the first preferred embodiment is characterized in comprising a conductor patch 12 having a feeding point 13 on an X-axis and a feeding point 14 on a Y-axis, and a power distributing and combining circuit 17 for controlling each of two radio signals fed to the feeding points 13 and 14 so that at least one of the amplitude and phase thereof are different from each other.

Referring to FIG. 1, on the top surface of a dielectric substrate 18 which has a top surface and a bottom surface which are parallel to each other and which has a grounding conductor 11 formed on the bottom surface, is formed the square-shaped conductor patch 12 whose one side has a length of half the wavelength of a resonance frequency with respect to which a dielectric constant of the dielectric substrate 18 is taken into consideration. For example, on an X-Y plane having an origin located in the center of the dielectric substrate 18, the conductor patch 12 is formed so that sides of the square of the conductor patch 12, which cross each other so as to be perpendicular to each other, are parallel to the X-axis and the Y-axis, respectively, and the center of the conductor patch 12 is positioned at the origin of the X-Y plane. Also, the feeding point 13 is positioned on the X-axis, that is, on the perpendicular bisector of one side in the Y-axis direction of the square of the conductor patch 12. On the other hand, the feeding point 14 is positioned on the X-axis, that is, on the perpendicular bisector of one side in the X-axis direction of the square of the conductor patch 12. Further, as described in detail hereinafter, the feeding point 13 is connected to a terminal 17*b* of the power distributing and combining circuit 17 via a feeding transmission line 15, and the feeding point 14 is connected to a terminal 17*c* of the power distributing and combining circuit 17 via a feeding transmission line 16.

Referring to FIG. 2, a through hole 87 is formed so as to penetrate the dielectric substrate 18 and the grounding conductor 11 just under the feeding point 13 in the thickness direction thereof. In the through hole 87, a through-hole conductor 85 is formed via a dielectric substance 86 so as to be electrically insulated from the dielectric substrate 18. One end of the through-hole conductor 85 is connected to the conductor patch 12 at the feeding point 13. The feeding transmission line 15 is, for example, a coaxial cable 80, and the coaxial cable 80 is formed by covering the surrounding of a central conductor 81 with a grounding conductor 83 via a dielectric substance 82. The central conductor 81 of the coaxial cable 80 is connected to another end of the through-hole conductor 85, and the grounding conductor 83 of the coaxial cable 80 is connected to the grounding conductor 11. Further, in a manner similar to the feeding transmission line 15, the feeding transmission line 16 connected to the feeding point 14 is of a coaxial cable and has a structure similar to that of the feeding transmission line 15.

Figure 3:
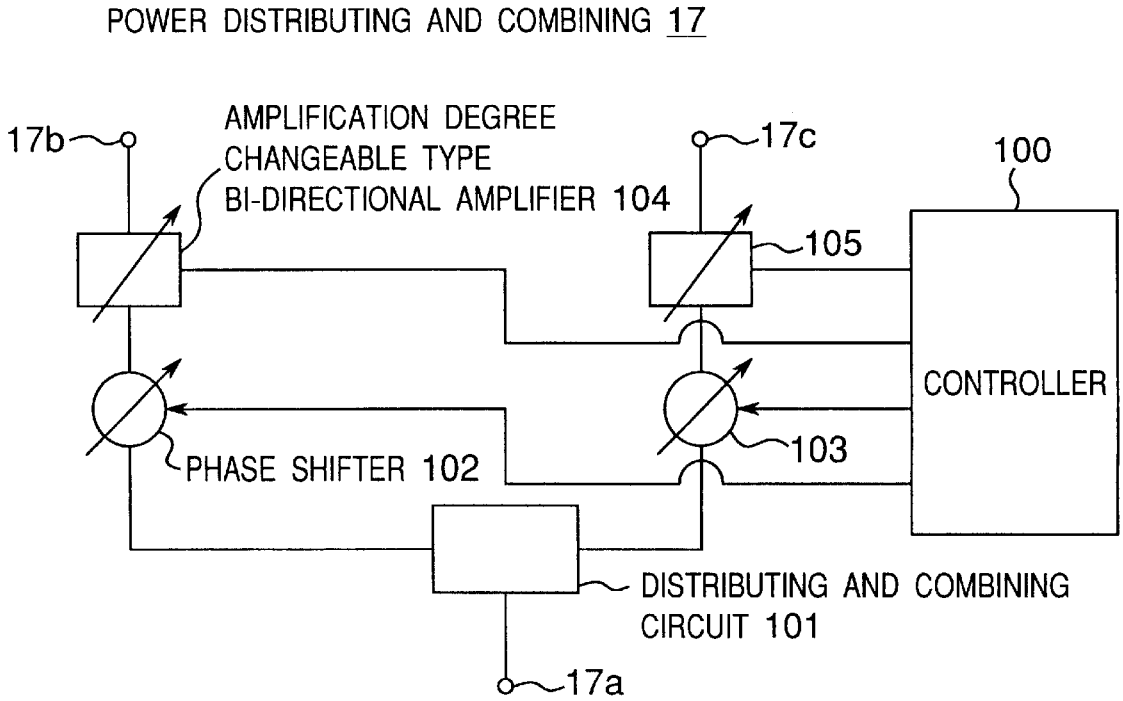
FIG. 3 is a block diagram showing a configuration of a power distributing and combining circuit in FIG. 1.

FIG. 3 is a block diagram showing a configuration of the power distributing and combining circuit 17 of FIG. 1. Referring to FIG. 3, the terminal 17*b* is connected to a distributing and combining circuit 101 via an amplification degree changeable type bi-directional amplifier 104 and a phase shifter 102. On the other hand, the terminal 17*c* is connected to the distributing and combining circuit 101 via an amplification degree changeable type bi-directional amplifier 105 and a phase shifter 103. The amplification degree of each of the bi-directional amplifiers 104 and 105 is controlled by a controller 100. The bi-directional amplifiers 104 and 105 control the amplitude of the radio signal which passes therethrough in two ways, and amplify and then output the radio signals. Also, the phase shift amount of each of the phase shifters 102 and 103 is controlled by the controller 100, and the phase shifters 102 and 103 control the phase of the radio signal which pass therethrough in two ways, and amplify and output the radio signals. Further, the distributing and combining circuit 101 combines the radio signal inputted from the phase shifter 102 with the radio signal inputted from the phase shifter 103, and outputs the combined radio signal to the terminal 17*a*. Also, the distributing and combining circuit 101 distributes the radio signal inputted via the terminal 17*a* into two radio signals of the same phase, outputs a first radio signal after the distribution to the phase shifter 102 and the bi-directional amplifier 104 via the terminal 17, and also outputs a second radio signal after the distribution to the phase shifter 103 and the bi-directional amplifier 105 via the terminal 17*c*.

The power distributing and combining circuit 17 constructed as mentioned above distributes the radio signal inputted via the terminal 17*a* into two radio signals, controls the amplitudes and phases of the two distributed radio signals, and outputs resultant signals via the terminals 17*b* and 17*c*. On the other hand, the power distributing and combining circuit 17 controls the amplitudes and phases of the two radio signals inputted via the terminals 17*b* and 17*c*, combines the resultant signals, and outputs the combined signal via the terminal 17*a*.

The operation of the patch antenna apparatus of the first preferred embodiment constructed as mentioned above will be described. In the present preferred embodiment, when a radio signal having the same resonance frequency as the above-mentioned resonance frequency is fed to the two feeding points 13 and 14, the patch antenna apparatus resonates in parallel with the X-axis, and also resonates in parallel with the Y-axis. Consequently, the radio signal is projected in the Z-axis direction, which is perpendicular to the X-Y plane and is opposite to the grounding conductor 11, as radio waves of the radio signals of the same resonance frequency having two linear polarizations which cross each other so as to be perpendicular to each other, where the radio waves include a linear polarization has an exciting direction parallel to the X-axis including the feeding point 13, and a linear polarization has an exciting direction parallel to the Y-axis including the feeding point 14.

In the present preferred embodiment, the controller 100 provided in the power distributing and combining circuit 17 controls the amplification degree changeable type bi-directional amplifiers 104 and 105 so that the amplitudes of the two radio signals fed to the feeding points 13 and 14 become different from each other. By thus making the power of the two radio signals fed to the feeding points 13 and 14 different from each other, the respective projection areas of the radio waves of the radio signal including the linear polarization having the exciting direction parallel to the X-axis including the feeding point 13 and that of the radio wave of the radio signal including the linear polarization having the exciting direction parallel to the Y-axis including the feeding point 14 can be made different from each other. Therefore, by thus making the powers of the two radio signals fed to the feeding points 13 and 14 different from each other so as to form the shape of a desired projection area, the desired projection area can be obtained by the patch antenna apparatus.

In the present preferred embodiment, the controller 100 provided in the power distributing and combining circuit 17 controls the phase shifters 102 and 103 so as to cause a phase difference between the two radio signals fed to the feeding points 13 and 14, thereby enabling the projection area of the radio wave of the radio signal including the linear polarization having the exciting direction parallel to the X-axis including the feeding point 13 and that of the radio wave of the radio signal including the linear polarization having the exciting direction parallel to the Y-axis including the feeding point 14 to be made different from each other. Therefore, by causing the phase difference between the two radio signals fed to the feeding points 13 and 14 so as to form the shape of a desired projection area, the desired projection area can be obtained by the patch antenna apparatus.

SECOND PREFERRED EMBODIMENT

Figure 5:
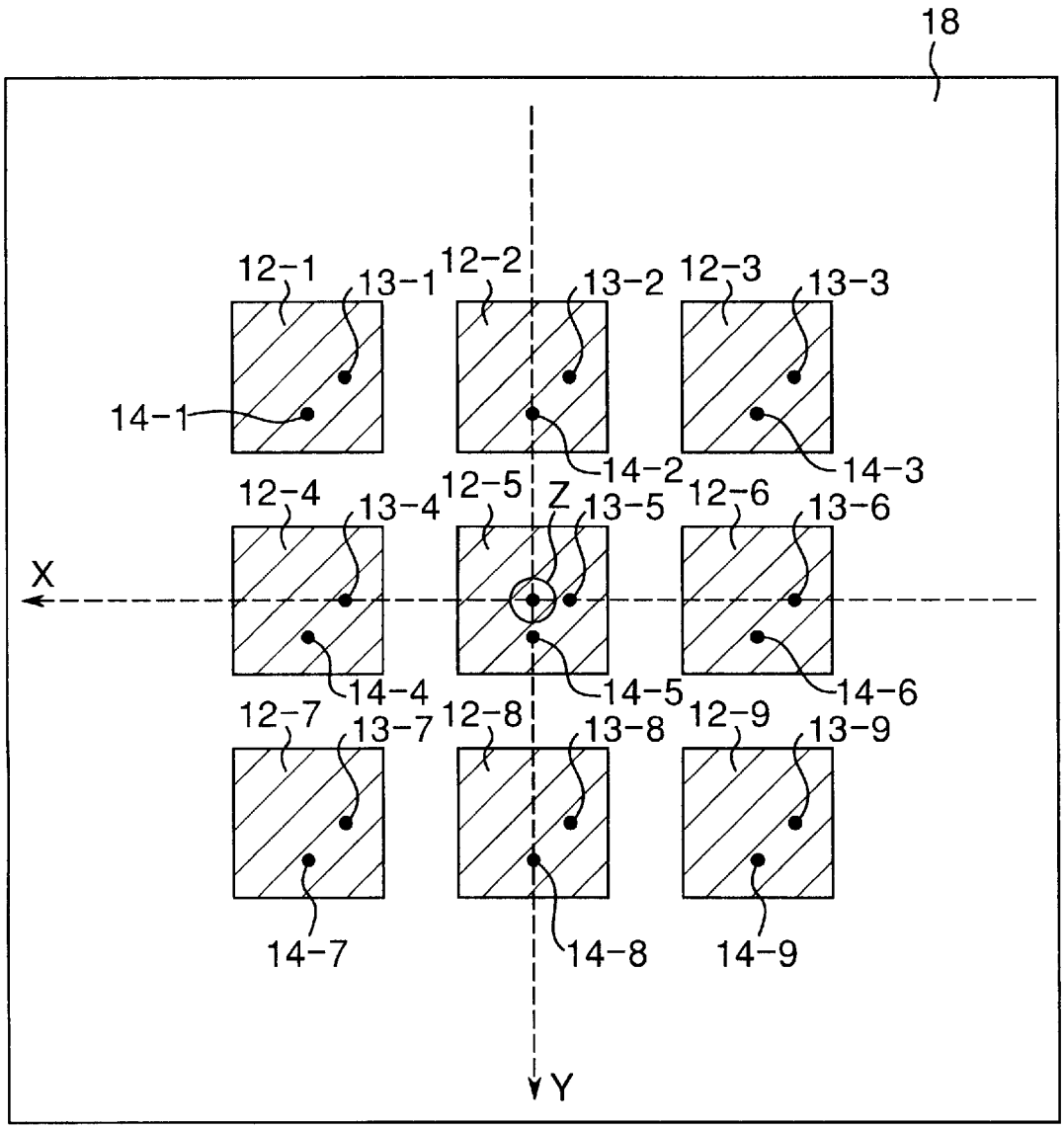
FIG. 5 is a plan view showing a configuration of a patch antenna apparatus of a second preferred embodiment according to the present invention.

FIG. 5 is a plan view showing a configuration of a patch antenna apparatus of a second preferred embodiment according to the present invention. A patch antenna apparatus of the second preferred embodiment is characterized in that nine patch antenna apparatuses each having a structure similar to that of the patch antenna of the first preferred embodiment are arranged on the dielectric substrate 18 so as to be apart from each other by, for example, a half wavelength (more specifically, the interval between the centers of neighboring ones among conductor patches 12-1 to 12-9 (generically called a conductor patch 12) is half the wavelength). The conductor patches 12-1 to 12-9 respectively have feeding points 13-1 to 13-9 for producing resonance in the X-axis direction, which are located at positions deviated in the X-axis direction from the centers of the respective conductor patches 12-1 to 12-9, and feeding points 14-1 to 14-9 for producing resonance in the Y-axis direction, which are located at positions deviated in the Y-axis direction from the centers of the respective conductor patches 12-1 to 12-9. The respective sides of the conductor patches 12-1 to 12-9 are formed so as to be parallel to the X-axis or Y-axis, respectively. It is to be noted that a plurality of conductor patches 12-1 to 12-9 are arranged so that the origin of the X-Y plane coincides with the center of the conductor patch 12-5.

Figure 4:
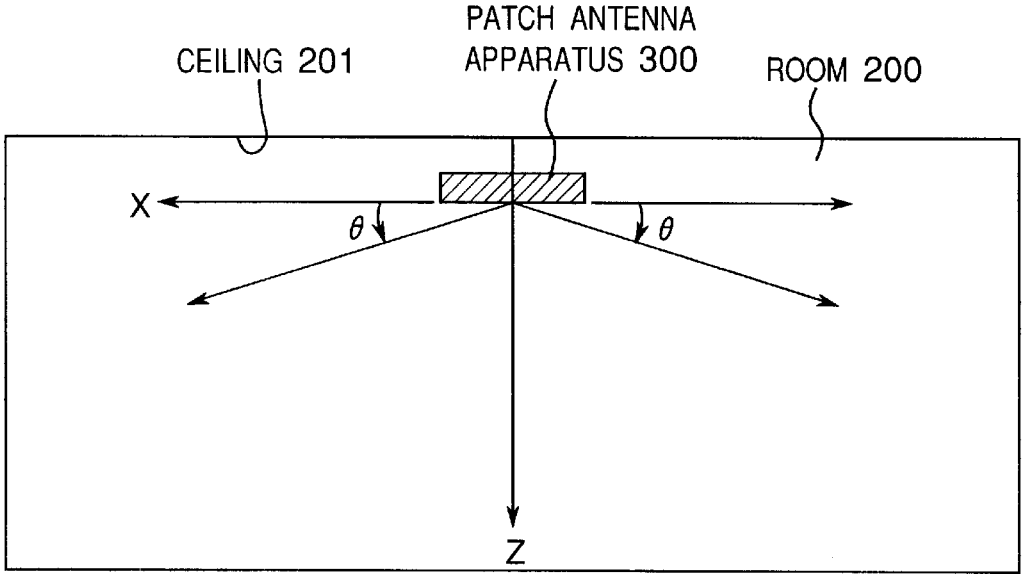
FIG. 4 is a cross sectional view showing a projection directional pattern when the patch antenna apparatus of respective preferred embodiments according to the present invention is provided on the ceiling of a room.

FIG. 4 is a cross sectional view showing a projection directional pattern when a patch antenna apparatus 300 of the respective preferred embodiments according to the present invention is installed on a ceiling 201 of a room 200. For example, when the patch antenna apparatus 300 is suspended from the center part of the ceiling 201 of the room 200 which is of a space whose height is short and which has a broadening in the horizontal direction, it is necessary to strongly project radio waves from the patch antenna apparatus 300 in the horizontal direction of the antenna apparatus or an inclined downward direction with a low elevation angle θ. In this case, the patch antenna apparatus according to the second preferred embodiment is preferable as described hereinbelow.

In the patch antenna apparatus according to the second preferred embodiment, by arranging the conductor patches 12-1 to 12-9 in a two-dimensional shape, an array antenna apparatus is formed. In this case, the controller 100 executes control so that the sum of the power fed to the first set of feeding points 13-1 to 13-9 for producing resonance in parallel to the X-axis and the sum of the power fed to the second set of feeding points 14-1 to 14-9 for producing resonance in parallel to the Y-axis are different from each other. Consequently, the size of the projection area of the linear polarizations parallel to the X-axis and that of the projection area of the linear polarizations parallel to the Y-axis are made different from each other, thereby enabling a desired projection area to be obtained. Alternately, the amplitudes or phases of the radio signals fed to the feeding points 13-1 to 13-9 and those to the feeding points 14-1 to 14-9 are made different from each other, thereby realizing a phased array antenna apparatus or adaptive array antenna apparatus. This leads to that a desired projection area can be obtained.

Although the plurality of conductor patches 12 are arranged in a two-dimensional shape in the above-mentioned preferred embodiment, the present invention is not limited to this, and a plurality of conductor patches 12 may be arranged in a one-dimensional shape.

THIRD PREFERRED EMBODIMENT

Figure 6:
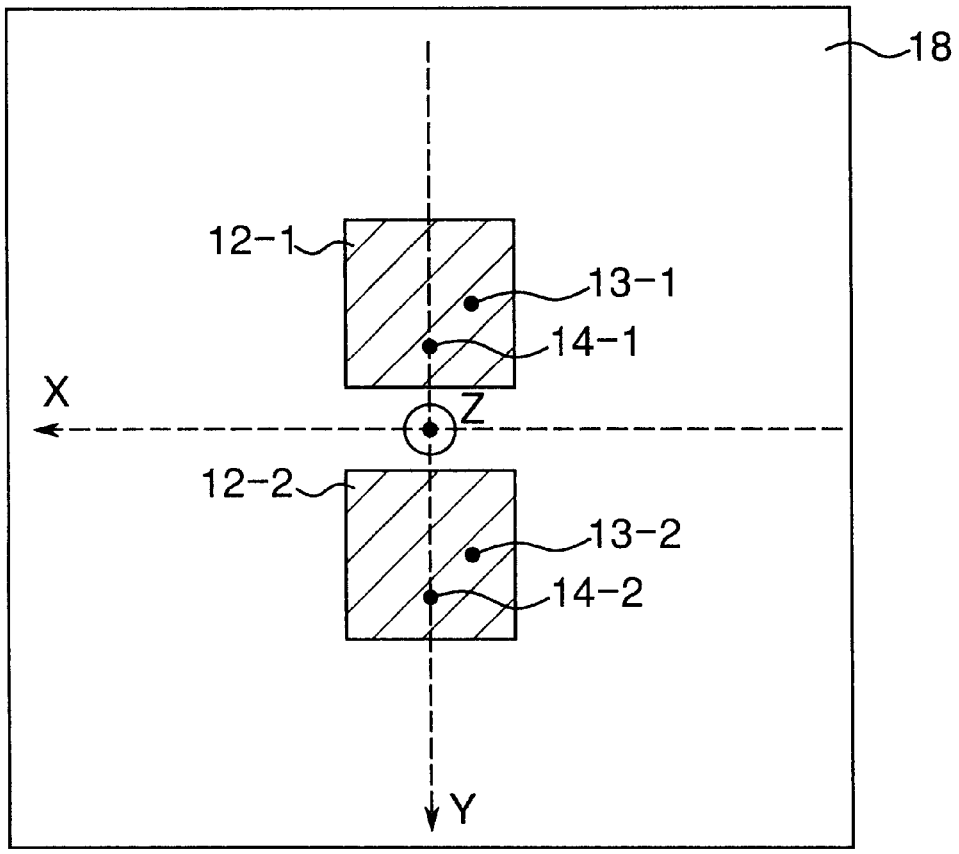
FIG. 6 is a plan view showing a configuration of a patch antenna apparatus of a third preferred embodiment according to the present invention.

FIG. 6 is a plan view showing a configuration of a patch antenna apparatus of a third preferred embodiment according to the present invention. The patch antenna apparatus of the third preferred embodiment is characterized in that two conductor patches 12-1 and 12-2 each having a configuration similar to that of the conductor patch 12 of the first preferred embodiment are formed on the dielectric substrate 18, for example, so as to be apart from each other by half the wavelength, along the Y-axis, and so as to be line-symmetrical with respect to the X-axis. In this case, each of the conductor patches 12-1 and 12-2 has the feeding points 13-1 and 13-2 which are located at positions deviated from the center of the conductor patches in the X-axis direction and which produce resonance in the X-axis direction, and has feeding points 14-land 14-2 which are located at positions deviated in the Y-axis direction and which produce resonance in the Y-axis direction. The conductor patches 12-1 and 12-2 are formed so that their sides are parallel to the X or Y-axis. The two conductor patches 12-1 and 12-2 are arranged so as to be line-symmetrical to each other with respect to the X-axis so that the origin of the X-Y plane coincides with the midpoint between the two conductor patches 12-1 and 12-2.

In the present preferred embodiment, in order to obtain a desired projection directional pattern, at least one of the amplitude and the phase of each of radio signals fed to the feeding points 13-1, 13-2, 14-1 and 14-2 is changed by using the power distributing and combining circuit 17 having a distribution ratio of 1:4. By changing the amplitude of the radio signal, the power thereof is changed as known to those skilled in the art.

Concretely, there are the following methods.

(a) It is controlled so that only the power distributed to one of the four feeding points 13-1, 13-2, 14-1, and 14-2 of the two conductor patches 12-1 and 12-2 is different from the power distributed to the other three feeding points.

(b) Also, it is controlled so that the respective powers distributed to all of the feeding points 13-1, 13-2, 14-1, and 14-2 are different from each other.

(c) Further, it is controlled so that the same power is fed to the two feeding points 13-1 and 13-2 which produce resonance in parallel to the X-axis, the same power is fed to the two feeding points 14-1 and 14-2 which produce resonance in parallel to the Y-axis, and the sum of the powers fed to the feeding points 13-1 and 13-2 which produce resonance in parallel to the X-axis and the sum of the powers fed to the feeding points 14-1 and 14-2 which produce resonance in parallel to the Y-axis are different from each other.

(d) Still further, it is controlled so that the same power is fed to the two feeding points 13-1 and 13-2 which produce resonance in parallel to the X-axis, and the power fed to one of the two feeding points 14-1 and 14-2 which produce resonance in parallel to the Y-axis is different from the power fed to another feeding point.

(e) It is controlled so that the power fed to one of the two feeding points 13-1 and 13-2 which produce resonance in parallel to the X-axis is different from the power fed to another feeding point, and the same power is fed to the two feeding points 14-1 and 14-2 which produce resonance in parallel to the Y-axis.

Although the method of causing the power difference has been described above, by causing the phase differences among the radio signals fed to the four feeding points 13-1, 13-2, 14-1, and 14-2, a desired projection directional pattern with respect to various spaces can be obtained.

As shown in FIG. 6, when radio signals of the same phase are fed to the feeding points 13-1 and 13-2 which produce resonance in parallel to the X-axis of the two conductor patches 12-1 and 12-2 arranged so as to be line-symmetrical to each other with respect to the X-axis, the projection directional pattern of the radio waves including the linearly polarization parallel to the X-axis of the patch antenna apparatus is characterized in that the intensity of the projected radio wave becomes stronger on the Z-X plane and then the gain thereof increases.

Also, as shown in FIG. 6, when the radio signals of the same phase are fed to the feeding points 14-1 and 14-2 which produce resonance in parallel to the Y-axis of the two conductor patches 12-1 and 12-2 arranged at positions so as to be line-symmetrical with respect to the X-axis, the projection directional pattern of the radio waves including the linearly polarization parallel to the Y-axis of the patch antenna apparatus is characterized in that the intensity of the projected radio wave becomes stronger on the ZX plane, and then, the gain thereof increases.

The two examples have the structures which are very useful for the patch antenna apparatus for use in a room, and which are useful when narrowing of the projection directional pattern and a large gain are necessary, in cases such as an antenna apparatus for use in suspending on a wall, an antenna apparatus which is installed on a ceiling of a longitudinal space such as a corridor or the like.

In the present preferred embodiment, the patch antenna apparatus is constructed by using the two conductor patches 12-1 and 12-2 arranged so as to be line-symmetrical to each other with respect to the X-axis. The present invention is not limited to this, and the patch antenna apparatus may be constructed by using three or more conductor patches (See FIG. 5). Specific examples will be described hereinbelow.

In a first specific example, each pair of conductor patches are arranged at positions line-symmetrical with respect to the X-axis. When radio signals of opposite phases are fed to feeding points which produce resonance in parallel to the X-axis of the two conductor patches every pair set of the conductor patches, the projection directional pattern of the radio waves including the linear polarization parallel to the X-axis of the patch antenna apparatus is characterized in that the projected radio wave is weakened on the ZX-plane, and the maximum projection direction becomes a direction of a low elevation angle on the ZY plane.

In a second specific example, each pair of conductor patches are arranged at positions which are line-symmetrical with respect to the X-axis. When radio signals of opposite phases are fed to the feeding points which produce resonance in parallel to the Y-axis of the two conductor patches every pair set of the conductor patches, the projection directional pattern of the radio waves including the linear polarization parallel to the Y-axis of the patch antenna apparatus is characterized in that the projected radio wave is weakened on the ZX plane, and the maximum projection direction becomes a direction of a low elevation angle on the ZY plane.

In the two specific examples constructed as mentioned above, by installing the patch antenna apparatus in the center of the ceiling of the room, the radio wave can be projected in a broader space, and a broader projection area can be obtained.

FOURTH PREFERRED EMBODIMENT

Figure 7:
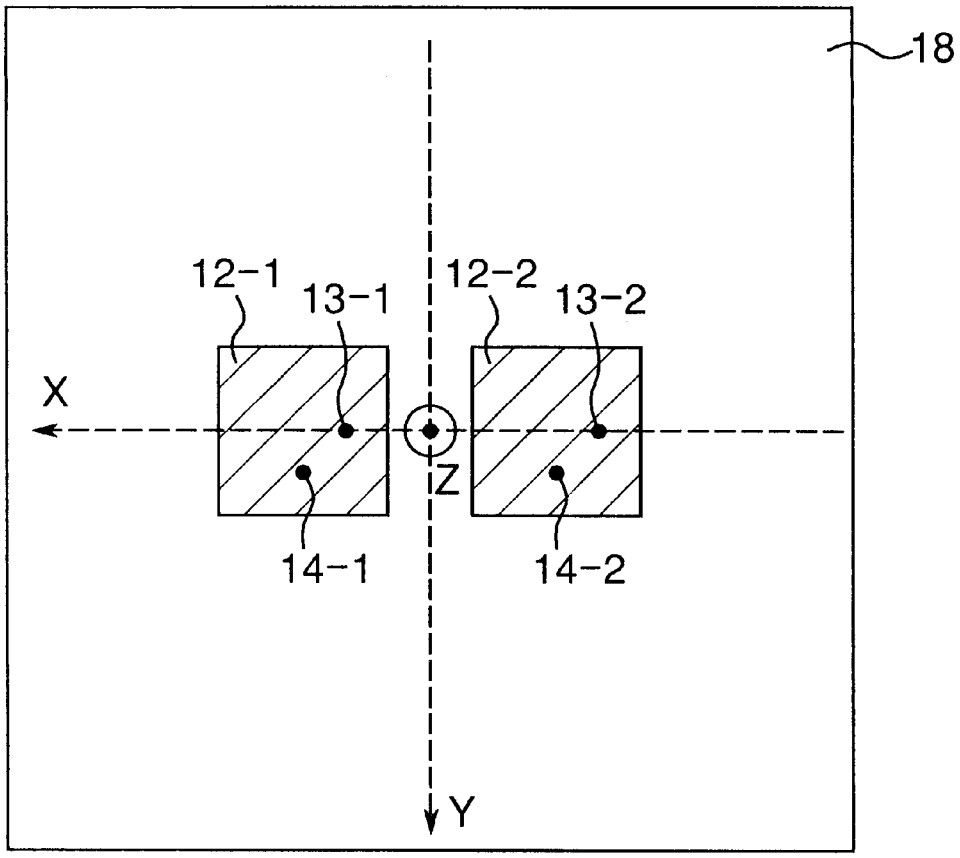
FIG. 7 is a plan view showing a configuration of a patch antenna apparatus of a fourth preferred embodiment according to the present invention.

FIG. 7 is a plan view showing a configuration of a patch antenna apparatus of a fourth preferred embodiment according to the present invention. The patch antenna apparatus of the fourth preferred embodiment is characterized in that the two conductor patches 12-1 and 12-2 each having a structure similar to that of the conductor patch 12 of the first preferred embodiment are formed on the dielectric substrate 18 so as to be apart from each other by, for example, half the wavelength, along the X-axis, and so as to be line-symmetrical with respect to the Y-axis. The conductor patches 12-1 and 12-2 have the feeding points 13-1 and 13-2 which are located at positions deviated from the center of the conductor patches in the X-axis direction, for producing resonance in the X-axis direction, and have feeding points 14-1 and 14-2 which are located at positions deviated from the center of the conductor patches in the Y-axis direction, for producing resonance in the Y-axis direction, respectively. The respective sides of the conductor patches 12-1 and 12-2 are formed so as to be parallel with the X or Y-axis. It is to be noted that the two conductor patches 12-1 and 12-2 are arranged so as to be line-symmetrical to each other with respect to the Y-axis so that the origin of the X-Y plane coincides with the midpoint between the two conductor patches 12-1 and 12-2.

In the present preferred embodiment, in order to obtain a desired projection directional pattern, in the manner shown in the third preferred embodiment, at least one of the amplitude and phase of each of radio signals fed to the feeding points 13-1, 13-2, 14-1, and 14-2 is changed by using the power distributing and combining circuit 17 having the distribution ratio of 1:4.

As shown in FIG. 7, when the radio signals of the same phase are fed to the feeding points 14-1 and 14-2 which produce resonance in parallel to the Y-axis of the two conductor patches 12-1 and 12-2 arranged so as to be line-symmetrical to each other with respect to the Y-axis, the projection directional pattern of the radio waves including the linear polarization parallel to the Y-axis of the patch antenna apparatus is characterized in that the projected radio wave becomes stronger on the ZY plane, and then the gain thereof increases.

As shown in FIG. 7, when radio signals of the same phase are fed to the feeding points 13-1 and 13-2 for producing resonance in parallel to the X-axis of the two conductor patches 12-1 and 12-2 arranged at positions which are line-symmetrical with respect to the Y-axis, the projection directional pattern of the radio waves including the linear polarization parallel to the X-axis of the patch antenna apparatus is characterized in that the projected radio wave becomes stronger on the ZY plane, and then, the gain thereof increases.

The two examples have the structures which are very useful as a patch antenna apparatus for a room, and are useful when narrowing of the projection directional pattern and the large gain of the antenna apparatus are necessary like a wall-hanging type antenna apparatus or an antenna apparatus provided on the ceiling of an elongated space such as a corridor.

In the present preferred embodiment, the patch antenna apparatus is constructed by using the two conductor patches 12-1 and 12-2 arranged so as to be line-symmetrical to each other with respect to the Y-axis. The present invention is not limited to this, and the patch antenna apparatus may be constructed by using three or more conductor patches (See FIG. 5). Specific examples will be described hereinbelow.

In a first specific example, each pair of conductor patches are arranged at positions line-symmetrical with respect to the Y-axis. When radio signals of opposite phases are fed to the feeding points which produce resonance in parallel to the Y-axis of the two conductor patches every pair set of the conductor patches, the projection directional pattern of the radio waves including the linear polarization parallel to the Y-axis of the patch antenna apparatus is characterized in that the projected radio wave is weakened on the ZY plane, and the maximum projection direction becomes a direction of a low elevation angle on the ZX plane.

In a second specific example, two conductor patches are arranged at positions so as to be line-symmetrical with respect to the Y-axis. When radio signals of opposite phases are fed to the feeding points which produce resonance in parallel to the X-axis of the two conductor patches every pair set of the conductor patches, the projection directional pattern of the radio waves including the linear polarization parallel to the X-axis of the patch antenna apparatus is characterized in that the projected radio wave is weakened on the ZY plane, and the maximum projection direction becomes a direction of a low elevation angle on the ZX plane.

In the two specific examples constructed as mentioned above, by installing the patch antenna apparatus in the center of the ceiling of the room, the radio wave can be projected in a broader space, and then, a broader projection area can be obtained.

FIFTH PREFERRED EMBODIMENT

Figure 8:
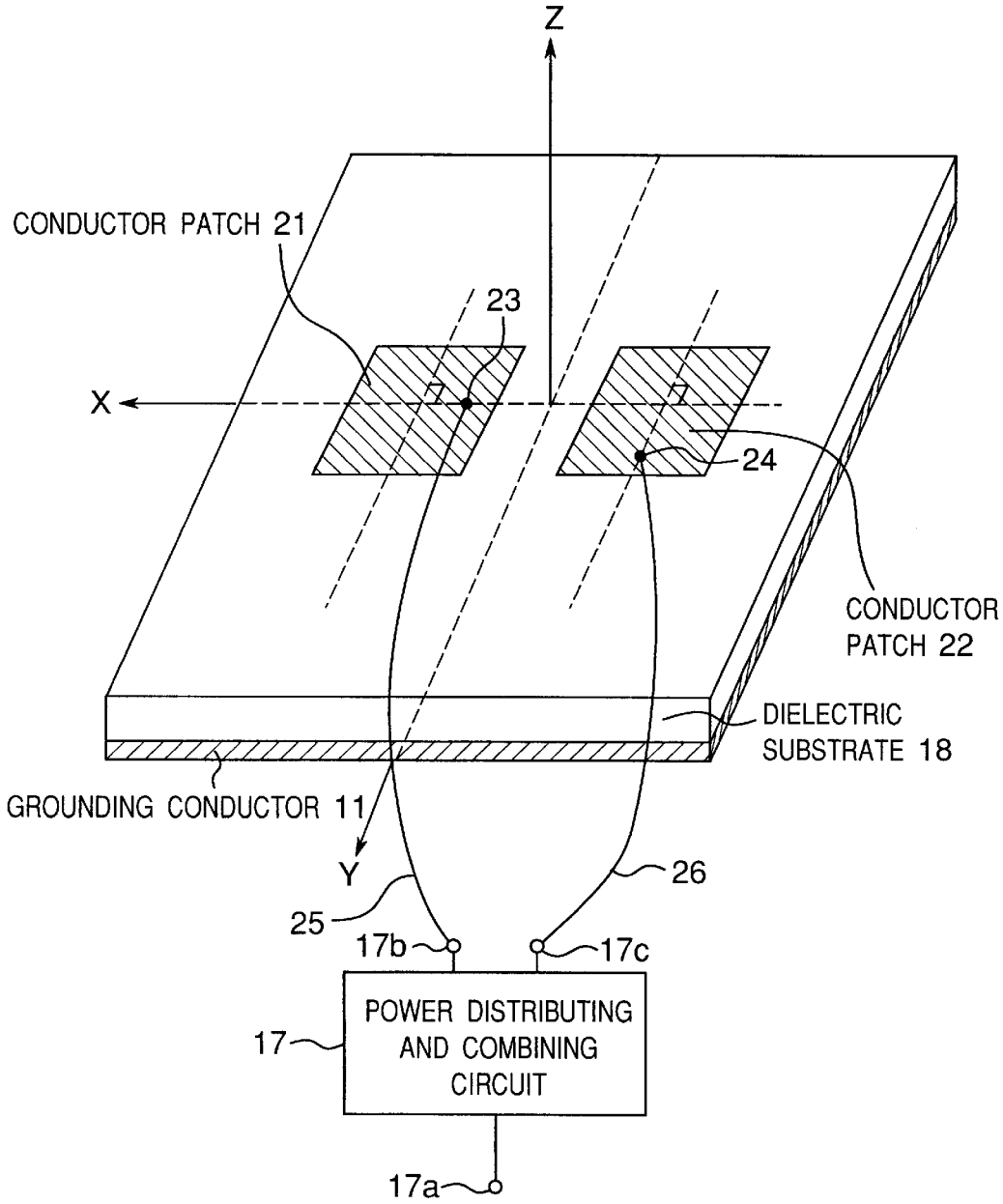
FIG. 8 is a perspective view showing a configuration of a patch antenna apparatus of a fifth preferred embodiment according to the present invention.

FIG. 8 is a perspective view showing a configuration of a patch antenna apparatus of a fifth preferred embodiment according to the present invention. In the patch antenna apparatus of the fifth preferred embodiment, a conductor patch 21 having a feeding point 23 which produces resonance in parallel to the X-axis, and a conductor patch 22 having a feeding point 24 which produces resonance in parallel to the Y-axis are formed on the dielectric substrate 18 along the X-axis so as to be line-symmetrical with respect to the Y-axis. Further, in a manner similar to the first preferred embodiment, the power distributing and combining circuit 17 for performing control so that at least one of the amplitudes and phases of the two radio signals fed to the feeding points 23 and 24 are different from each other is provided.

Referring to FIG. 8, on the top surface of the dielectric substrate 18 having the grounding conductor 11 formed on the bottom surface, the conductor patches 21 and 22 each having a square shape whose one side is half the wavelength of the resonance frequency in which the dielectric constant of the dielectric substrate 18 is taken into consideration are formed as follows. For example, on the X-Y plane having the origin located in the center of the dielectric substrate 18, the sides of the square of each of the conductor patches 21 and 22 which cross each other so as to be perpendicular to each other are parallel with the X-axis or Y-axis, and the midpoint between the center points of the conductor patches 21 and 22 is positioned at the origin of the X-Y plane. Also, the feeding point 23 of the conductor patch 21 is positioned on the X-axis, that is, on the perpendicular bisector of one side in the Y-axis direction of the square of the conductor patch 21. On the other hand, the feeding point 24 of the conductor patch 22 is positioned on the perpendicular bisector of one side in the X direction of the square of the conductor patch 22. Further, the feeding point 23 is connected to the terminal 17*b* of the power distributing and combining circuit 17 via a feeding transmission line 25, and the feeding point 24 is connected to the terminal 17*c* of the power distributing and combining circuit 17 via a feeding transmission line 26. It is to be noted that, in a manner similar to that of the first preferred embodiment, each of the connection between the feeding point 23 and the feeding transmission line 25 and the connection between the feeding point 24 and the feeding transmission line 26 is carried out via a through-hole conductor.

The operation of the patch antenna apparatus of the fifth preferred embodiment constructed as mentioned above will be described. In the present preferred embodiment, when radio signals having the same resonance frequency as the above-mentioned resonance frequency are fed to the two feeding points 23 and 24, the patch antenna apparatus resonates in parallel with the X-axis, and also resonates in parallel with the Y-axis. The radio signal is therefore projected in the Z-axis direction, which is perpendicular to the X-Y plane and which is opposite to the grounding conductor 11, as radio waves of the radio signal having the same resonance frequency including two linear polarizations which cross each other so as to be perpendicular to each other, where the radio waves include a linear polarization having the exciting direction parallel to the X-axis including the feeding point 23, and a linear polarization having the exciting direction parallel to the Y-axis including the feeding point 24.

In the present preferred embodiment, the controller 100 provided in the power distributing and combining circuit 17 controls the amplification degree changeable type bi-directional amplifiers 104 and 105 so that the amplitudes of the two radio signals fed to the feeding points 23 and 24 become different from each other. By thus making the powers of the two radio signals fed to the feeding points 23 and 24 different from each other, the projection area of the radio wave of the radio signal including the linear polarization having the exciting direction parallel to the X-axis including the feeding point 23 and that of the radio wave of the radio signal including the linear polarization having the exciting direction parallel to the Y-axis including the feeding point 24 can be made different from each other. Consequently, by making the powers of the two radio signals fed to the feeding points 23 and 24 different from each other so as to form a desired projection area, the desired projection area can be obtained by the patch antenna apparatus.

In the present preferred embodiment, the controller 100 provided in the power distributing and combining circuit 17 controls the phase shifters 102 and 103 so as to cause a phase difference between the two radio signals fed to the feeding points 23 and 24, thereby enabling the projection area of the radio wave of the radio signal including the linear polarization having the exciting direction parallel to the X-axis including the feeding point 23, and that of the radio wave of the radio signal including the linear polarization having the exciting direction parallel to the Y-axis including the feeding point 24 to be made different from each other. Consequently, by causing a phase difference between the two radio signals fed to the feeding points 23 and 24 so as to form a desired shape of the projection area, the desired projection area can be obtained by the patch antenna apparatus.

SIXTH PREFERRED EMBODIMENT

Figure 9:
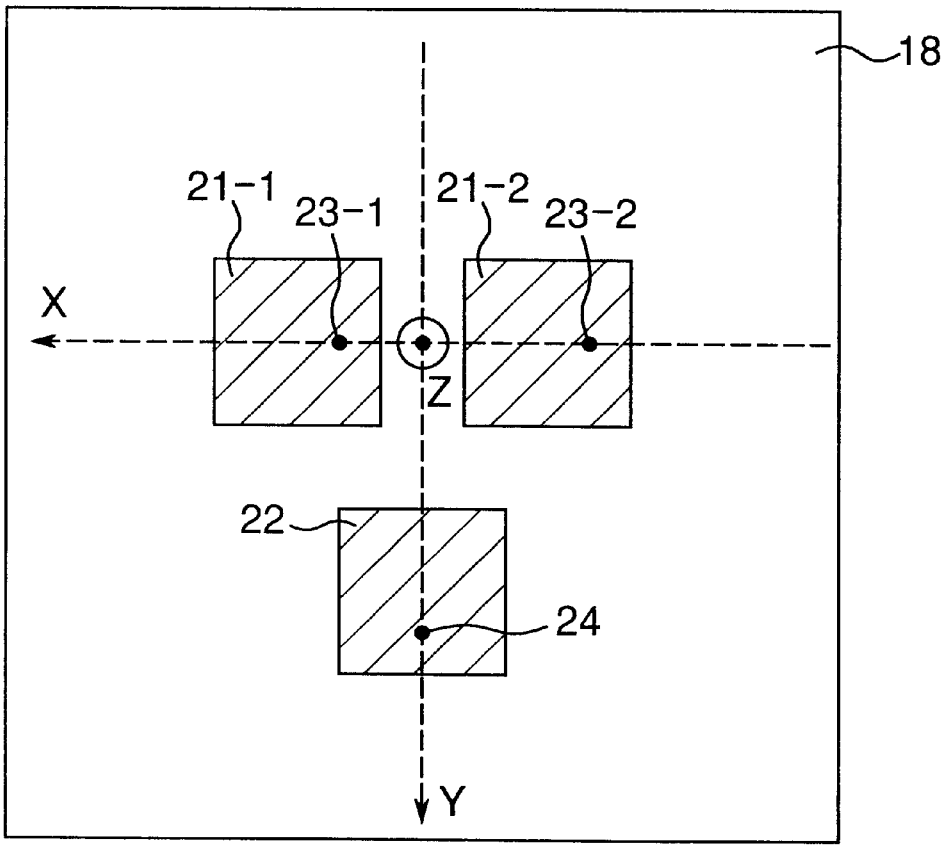
FIG. 9 is a plan view showing a configuration of a patch antenna apparatus of a sixth preferred embodiment according to the present invention.

FIG. 9 is a plan view showing a configuration of a patch antenna apparatus of a sixth preferred embodiment according to the present invention. The patch antenna apparatus of the sixth preferred embodiment is characterized by comprising two conductor patches 21-1 and 21-2 having feeding points 23-1 and 23-2, respectively, which produce resonance in parallel to the X-axis, and a conductor patch 22 having a feeding point 24 which produces resonance in parallel to the Y-axis.

In the present preferred embodiment, the following methods can be employed as a method of distributing the power to the conductor patches 21-1 and 21-2, and 22.

(a) It is controlled so that the powers fed to the three conductor patches 21-1, 21-2, and 22 are equal to each other. In this case, the ratio of the sum of the powers fed to a set of the conductor patches 21-1 and 21-2 which produce resonance in parallel to the X-axis, to the power fed to the conductor patch 22 which produces resonance in parallel to the Y-axis is 2:1.

(b) Also, it is controlled so that the respective powers fed to the two conductor patches 21-1 and 21-2 which produce resonance in parallel to the X-axis are equal to each other, and the power fed to the conductor patch 22 which produces resonance in parallel to the Y-axis is different from the power fed to the conductor patches 21-1 and 21-2 which produce resonance in parallel to the X-axis.

(c) Further, it is controlled so that the powers supplied to the two feeding points 21-1 and 21-2 which produce resonance in parallel to the X-axis are different from each other In the case of a one-dimensional array antenna apparatus like the two conductor patches 21-1 and 21-2, in particular in the case of a phased array antenna apparatus in which a phase difference is caused between radio signals fed to the antenna apparatuses constructing an array antenna apparatus, when the respective same powers are fed to the two antenna apparatuses, there may be caused a point or a direction in which the projected radio wave becomes extremely small in the projection space. The two antenna apparatuses will be described as an example. In the point or a direction where an electric distance difference from the antenna apparatuses is a phase difference of 180 degrees, that is, phases become opposite, the radio waves projected from the two antenna apparatuses are cancelled out. That is, as the example of the power distribution, by making the powers distributed to the respective conductor patches of antenna apparatuses different from each other when the array antenna apparatus is constructed, while holding a rough projection pattern due to an advantageous effect of the phased array antenna apparatus, the point or the direction in which the projection radio wave becomes extremely small can be prevented from being provided. Consequently, it is very useful in mobile radio communication systems in which continuous speech during movement is important.

(d) Also, it is controlled so that the powers fed to all of the conductor patches 21-1, 21-2, and 22 are different from each other.

(e) Further, it is controlled so that only the power fed to one of the two conductor patches 21-1 and 21-2 which produce resonance in parallel to the X-axis is different from that fed to another conductor patch.

As mentioned above, by controlling the powers fed to the conductor patches 21-1, 21-2, and 22, the projection directional pattern can be changed, and then, a desired projection area can be obtained in various spaces.

Further, by causing a phase difference in the radio signals fed to the three conductor patches 21-1,. 21-2, and 22, the projection directional pattern can be changed and a desired projection area can be obtained in various spaces.

In the present preferred embodiment, when the radio signals of the same phase are fed to the conductor patches 21-1 and 21-2 arranged at line-symmetrical positions with respect to the Y-axis, the projection directional pattern of the patch antenna apparatus is characterized in that the projection radio wave becomes stronger on the ZY plane, and then, the gain thereof increases. The present preferred embodiment has a very useful structure for a patch antenna for use in a room. In particular, by installing the patch antenna apparatus in the center of the ceiling of a room, the radio wave can be projected in a broader space, so that a broader projection area can be obtained.

SEVENTH PREFERRED EMBODIMENT

Figure 10:
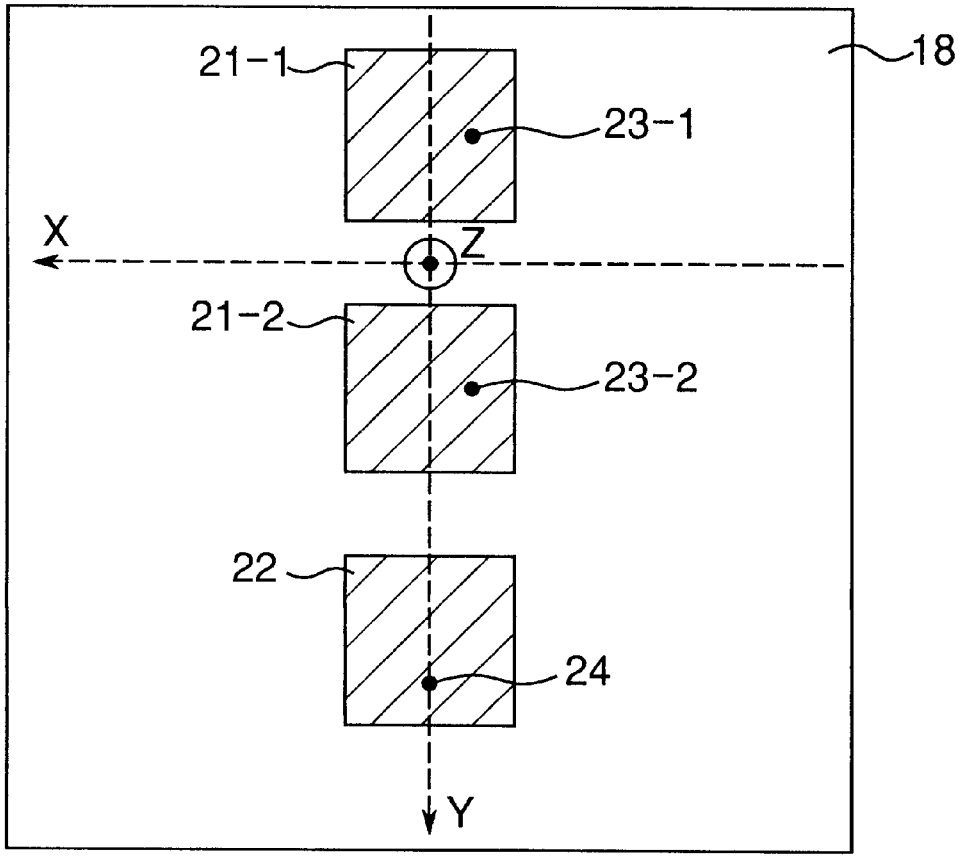
FIG. 10 is a plan view showing a configuration of a patch antenna apparatus of a seventh preferred embodiment according to the present invention.

FIG. 10 is a plan view showing a configuration of a patch antenna apparatus of a seventh preferred embodiment according to the present invention. The patch antenna apparatus of the seventh preferred embodiment comprises the conductor patches 21-1 and 21-2 having feeding points 23-1 and 23-2, respectively, which produce resonance in parallel to the X-axis, and a conductor patch 22 having a feeding point 24 which produces resonance in parallel to the Y-axis, and is characterized in that the two conductor patches 21-1 and 21-2 are arranged so as to be line-symmetrical to each other with respect to the X-axis.

In the present preferred embodiment, when radio signals of the same phase are fed to the conductor patches 21-1 and 21-2 arranged so as to be line-symmetrical to each other with respect to the X-axis, the projection directional pattern of the patch antenna apparatus is characterized in that the projection radio wave becomes stronger on the ZX plane, and the gain thereof increases. The present preferred embodiment has a very useful structure for a patch antenna for a room, and in particular, is useful when narrowing of the projection directional pattern and the large gain of the antenna are necessary like a wall-hanging type antenna apparatus or an antenna apparatus mounted on the ceiling of an elongated space such as a corridor.

EIGHTH PREFERRED EMBODIMENT

Figure 11:
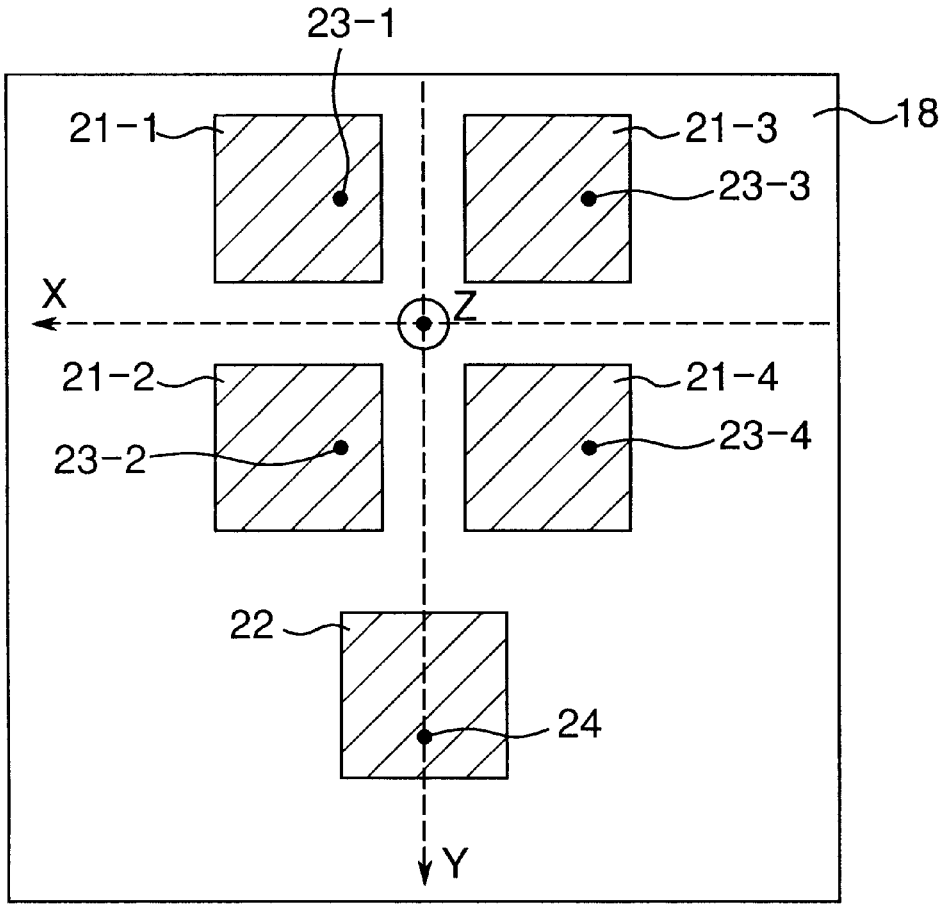
FIG. 11 is a plan view showing a configuration of a patch antenna apparatus of an eighth preferred embodiment according to the present invention.

FIG. 11 is a plan view showing a configuration of a patch antenna apparatus of an eighth preferred embodiment according to the present invention. The patch antenna apparatus of the eighth preferred embodiment comprises four conductor patches 21-1 to 21-4 having the feeding points 23-1 to 23-4 which produce resonance in parallel to the X-axis, respectively, and the conductor patch 22 having the feeding point 24 which produces resonance in parallel to the Y-axis. It is characterized in that pair sets of two conductor patches (21-1 and 21-2, and 21-3 and 21-4) are arranged so as to be line-symmetrical to each other with respect to the X-axis and the pair sets of two conductor patches (21-1 and 21-3, and 21-2 and 21-4) are arranged so as to be line-symmetrical to each other with respect to the Y-axis.

In the present preferred embodiment, when radio signals of the opposite phases are fed to two conductor patches (21-1 and 21-2, and 21-3 and 21-4), every pair set of conductor patches which are arranged so as to be line-symmetrical to each other with respect to the X-axis, the projection directional pattern of the patch antenna apparatus is characterized in that the projection radio wave is weakened on the ZX plane, and the maximum projection direction becomes a direction of a low elevation angle on the ZY plane. The present preferred embodiment has a very useful structure for a patch antenna apparatus for a room. In particular, by installing the patch antenna apparatus in the center part of the ceiling of a room, the radio wave can be projected in a broader space, so that a broader projection area can be obtained.

In the present preferred embodiment, when radio signals of the opposite phases are fed to two conductor patches (21-1 and 21-3, and 21-3 and 21-4) every pair set of conductor patches, which are arranged so as to be line-symmetrical to each other with respect to the Y-axis, the projection directional pattern of the patch antenna apparatus is characterized in that the projection radio wave is weakened on the ZY plane, and the maximum projection direction becomes a direction of a low elevation angle on the ZX plane. The present preferred embodiment has a very useful structure for a patch antenna apparatus for a room. In particular, by installing the patch antenna apparatus in the center part of the ceiling of a room, the radio wave can be projected in a broader space, so that a broader projection area can be obtained.

NINTH PREFERRED EMBODIMENT

Figure 12:
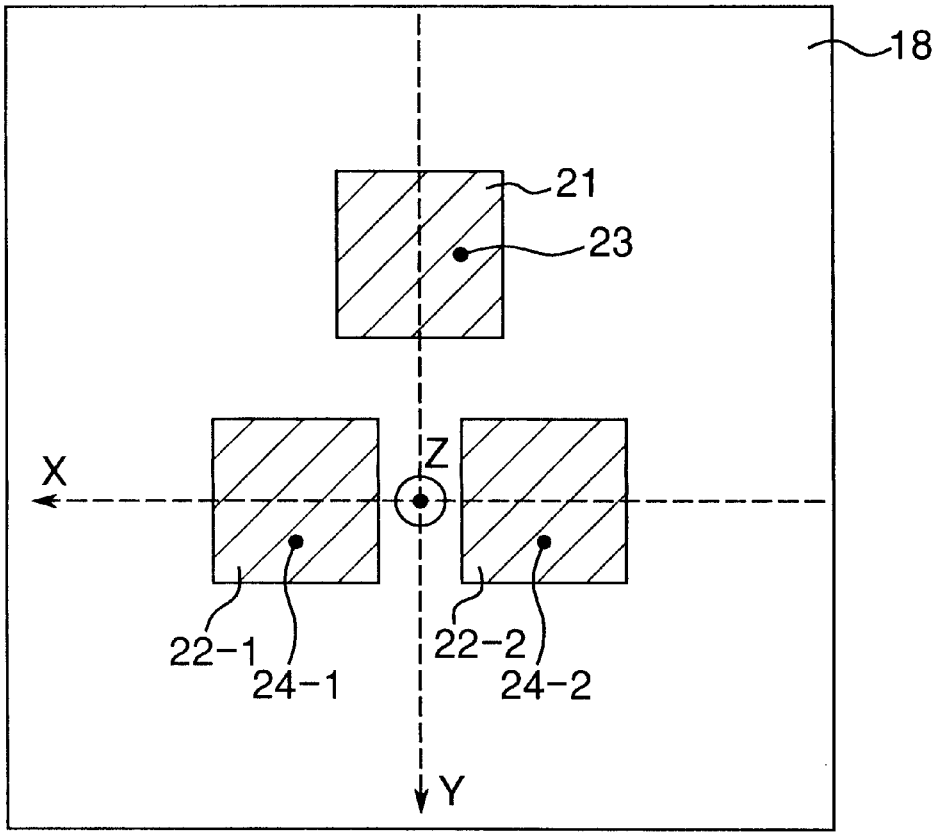
FIG. 12 is a plan view showing a configuration of a patch antenna apparatus of a ninth preferred embodiment according to the present invention.

FIG. 12 is a plan view showing a configuration of a patch antenna apparatus of a ninth preferred embodiment according to the present invention. The patch antenna apparatus of the ninth preferred embodiment comprises a conductor patch 21 having a feeding point 23 which produces resonance in parallel to the X-axis, and two conductor patches 22-1 and 22-2 having the feeding points 24-1 and 24-2, respectively, which produce resonance in parallel to the Y-axis, and is characterized in that the two conductor patches 22-1 and 22-2 are arranged so as to be line-symmetrical to each other with respect to the Y-axis.

In the present preferred embodiment, when radio signals of the same phase are fed to the two conductor patches 22-1 and 22-2 which are arranged so as to be line-symmetrical to each other with respect to the Y-axis, the projection directional pattern of the patch antenna apparatus is characterized in that the projection radio wave becomes stronger on the ZY plane, and the gain thereof increases. The present preferred embodiment is very useful for a patch antenna apparatus for a room. It is particularly useful for a hanging type antenna apparatus or an antenna apparatus provided on the ceiling of an elongated space such as a corridor, in which narrowing of the projection directional pattern and large antenna gain are necessary.

TENTH PREFERRED EMBODIMENT

Figure 13:
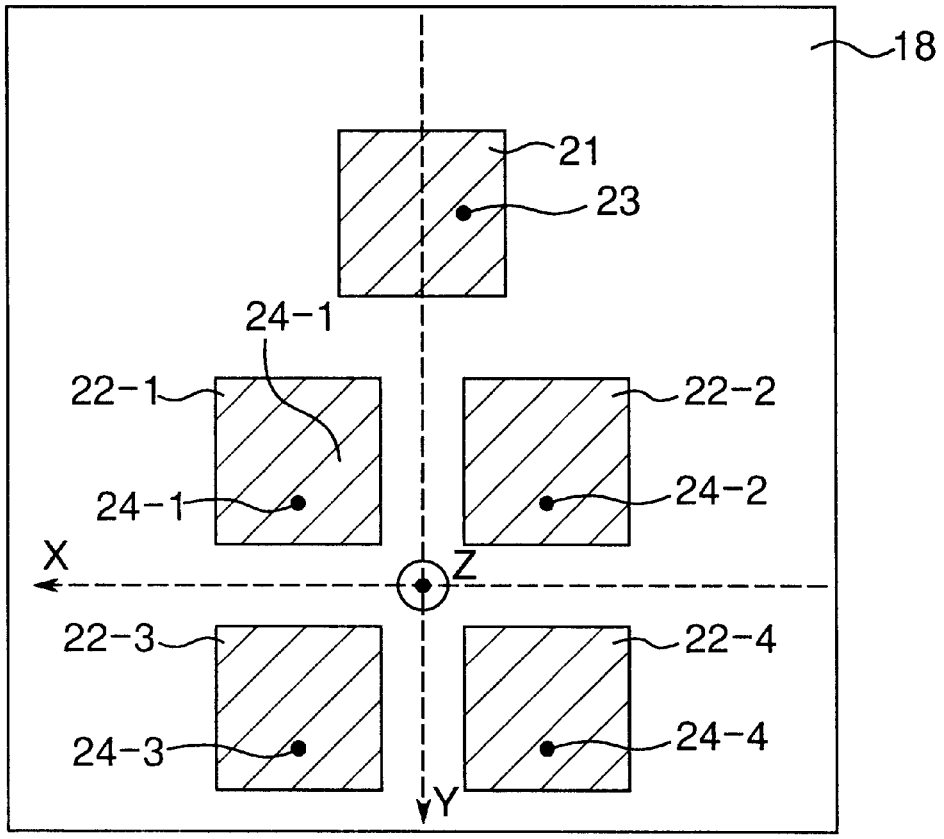
FIG. 13 is a plan view showing a configuration of a patch antenna apparatus of a tenth preferred embodiment according to the present invention.

FIG. 13 is a plan view showing a configuration of a patch antenna apparatus of a tenth preferred embodiment according to the present invention. The patch antenna apparatus of the tenth preferred embodiment comprises a conductor patch 21 having a feeding point 23 which produces resonance in parallel to the X-axis, and four conductor patches 22-1 to 22-4 having the feeding points 24-1 to 24-4 which produce resonance in parallel to the Y-axis, respectively, and is characterized in that each pair set of two conductor patches (22-1 and 22-2, and 22-3 and 22-4) are disposed so as to be line-symmetrical with respect to the Y-axis, and each pair set of two conductor patches (22-1 and 22-3, and 22-2 and 22-4) are disposed so as to be line-symmetrical with respect to the X-axis.

In the present preferred embodiment, when radio signals of opposite phases are fed to two conductor patches (22-1 and 22-2, and 22-3 and 22-4) every pair set of conductor patches, which are arranged so as to be line-symmetrical to each other with respect to the Y-axis, the projection directional pattern of the patch antenna apparatus is characterized in that the projection radio wave is weakened on the ZY plane, and the maximum projection direction becomes the direction of a low elevation angle on the ZX plane. The present preferred embodiment has a very useful structure for a patch antenna apparatus for a room. In particular, by installing the patch antenna apparatus in the center part of the ceiling of a room, the radio wave can be projected in a broader space, so that a broader projection area can be obtained.

In the present preferred embodiment, when radio signals of the opposite phases are fed to two conductor patches (22-1 and 22-3, and 22-2 and 22-4) every pair set of conductor patches, which are disposed so as to be line-symmetrical with respect to the X-axis, the projection directional pattern of the patch antenna apparatus is characterized in that the projection radio wave is weakened on the ZX plane, and the maximum projection direction is the direction of a low elevation angle on the ZY plane. The present preferred embodiment has a very useful structure for a patch antenna apparatus for a room. In particular, by installing the patch antenna apparatus in the center part of the ceiling of a room, the radio wave can be projected in a broader space, so that a broader projection area can be obtained.

ELEVENTH PREFERRED EMBODIMENT

Figure 14:
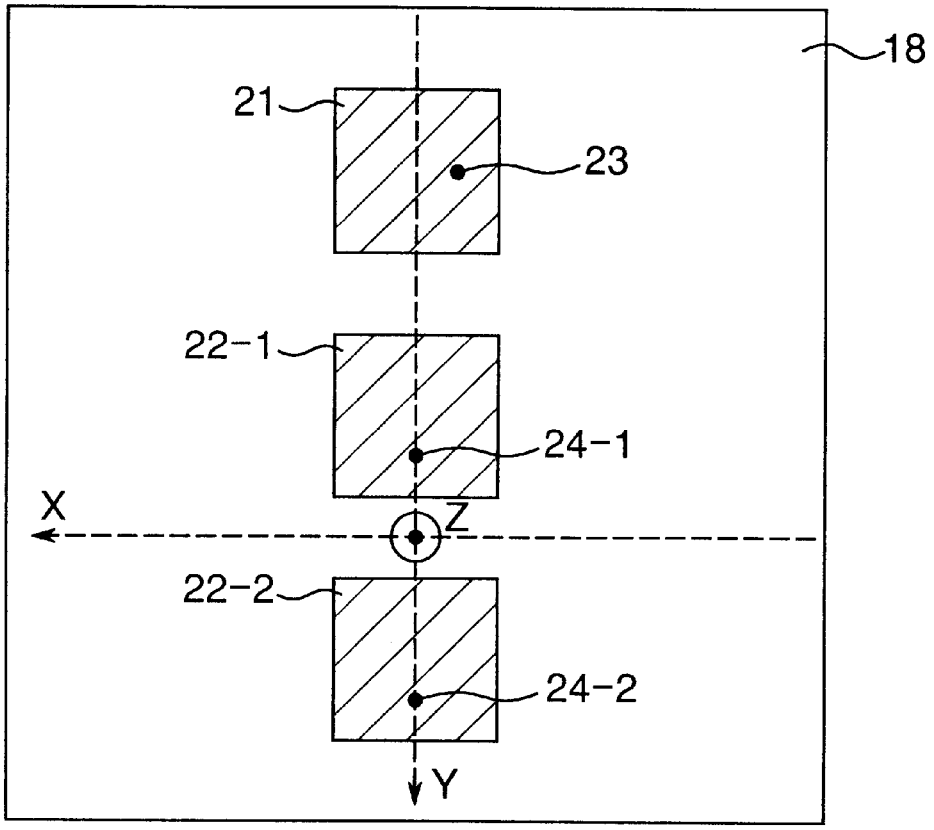
FIG. 14 is a plan view showing a configuration of a patch antenna apparatus of an eleventh preferred embodiment according to the present invention.

FIG. 14 is a plan view showing a configuration of a patch antenna apparatus of an eleventh preferred embodiment according to the present invention. The patch antenna apparatus of the eleventh preferred embodiment comprises a conductor patch 21 having a feeding point 23 which produces resonance in parallel to the X-axis, and two conductor patches 22-1 and 22-2 having feeding points 24-1 and 24-2 which produce resonance in parallel to the X-axis, respectively, and is characterized in that the two conductor patches 22-1 and 22-2 are disposed so as to be line-symmetrical with respect to the X-axis.

In the present preferred embodiment, when radio signals of the same phase are supplied to two conductor patches 22-1 and 22-2 which are arranged so as to be line-symmetrical to each other with respect to the X-axis, the projection directional pattern of the patch antenna apparatus is characterized in that the projection radio wave becomes stronger on the ZX plane, and the gain thereof increases. The present preferred embodiment has a very useful structure for a patch antenna apparatus for a room. In particular, it is useful for a hanging type antenna apparatus or an antenna apparatus provided on the ceiling of an elongated space such as a corridor, in which narrowing of projection directional pattern and large antenna gain are necessary.

TWELFTH PREFERRED EMBODIMENT

Figure 15:
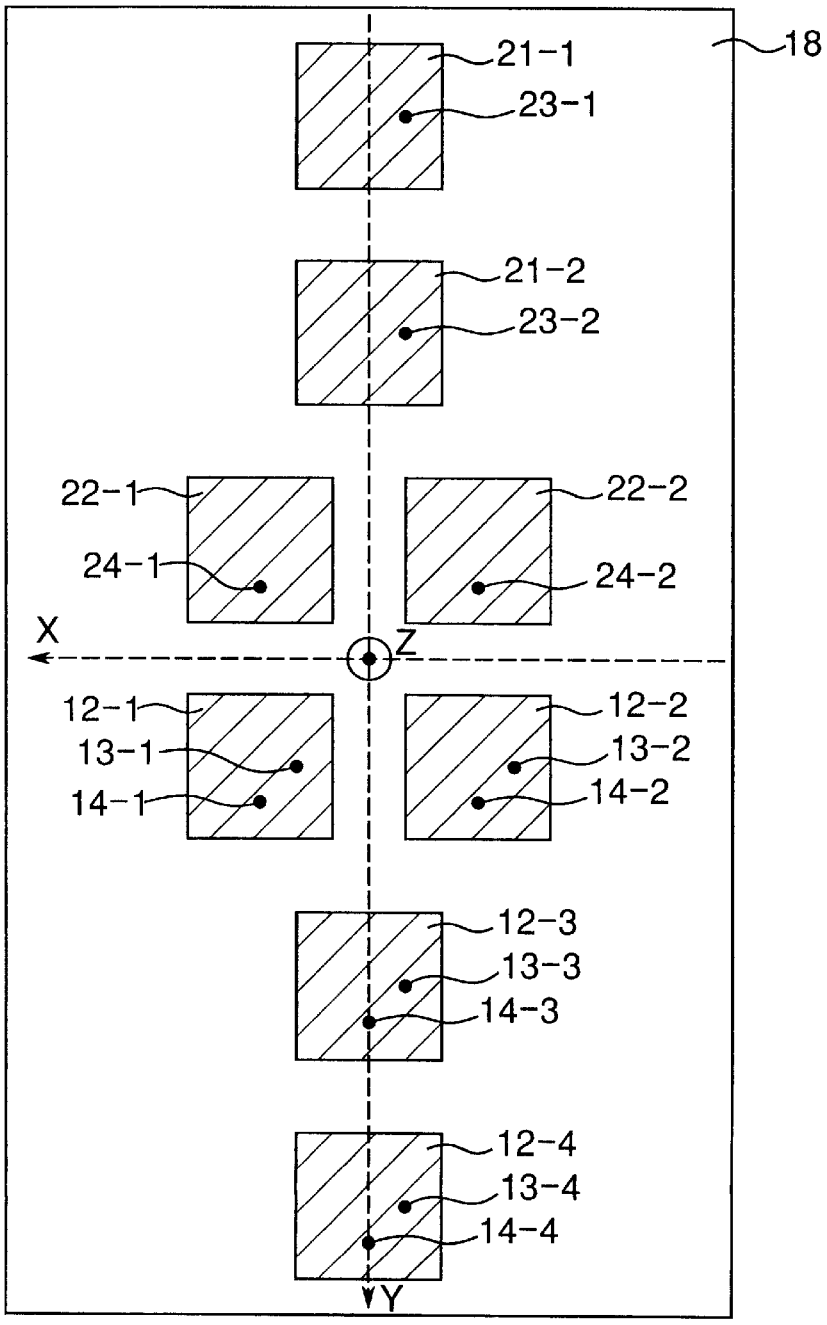
FIG. 15 is a plan view showing a configuration of a patch antenna apparatus of a twelfth preferred embodiment according to the present invention.

FIG. 15 is a plan view showing a configuration of a patch antenna apparatus of a twelfth preferred embodiment according to the present invention. The patch antenna apparatus of the twelfth preferred embodiment is characterized in that the following groups are formed on the dielectric substrate 18 to be mixed or combined:

(a) a conductor patch group of a one feeding point type including the conductor patches 21-1 and 21-2 having the feeding points 23-1 and 23-2 each of which produces resonance in parallel to the X-axis, and the conductor patches 22-1 and 22-2 having the feeding points 24-1 and 24-2, each of which produces resonance in parallel to the Y-axis; and (b) a conductor patch group of a two feeding point type including the conductor patches 12-1 to 12-4 having the feeding points 13-1 to 13-4 each of which produces resonance in parallel to the X-axis, and the feeding points 14-1 to 14-4, each of which produces resonance in parallel to the Y-axis, respectively.

In the present preferred embodiment, radio signals are fed to the conductor patches 12-1 to 12-4 and 21-1, 21-2, 22-1 and 22-2 in a manner similar to that of the above-mentioned preferred embodiment. Thus, the projection directional pattern can be more freely controlled, so that a desired projection area can be obtained.

MODIFIED PREFERRED EMBODIMENTS

In the above preferred embodiments, the patch antenna apparatus is constructed by using the conductor patches 12, 21, and 22 each having a square shape whose one side has a length of a half wavelength. The present invention is not limited to this. A patch antenna apparatus can be also constructed by using a square-shaped conductor patch whose one side has a length of integer times half the wavelength or a length of integer times of 0.4 to 0.6 of the wavelength.

In the present preferred embodiments, it is also possible to electrically connect one of two facing resonance ends to the grounding conductor 11 by using the conductor patches 12, 21, and 22 each having the square shape whose one side is a length of half the wavelength, so as to set the length in the resonance direction of each of the conductor patches 12, 21, and 22 which is a length between resonance ends of the two sides to a quarter of the wavelength on the basis of the wavelength in which the dielectric constant of the dielectric substrate 18 is taken into consideration. In this case, there can be obtained actions and advantageous effects similar to those of the patch antenna apparatus by using the conductor patches 12, 21, and 22 each having the square shape whose one side has a length of half the wavelength.

Figure 16:
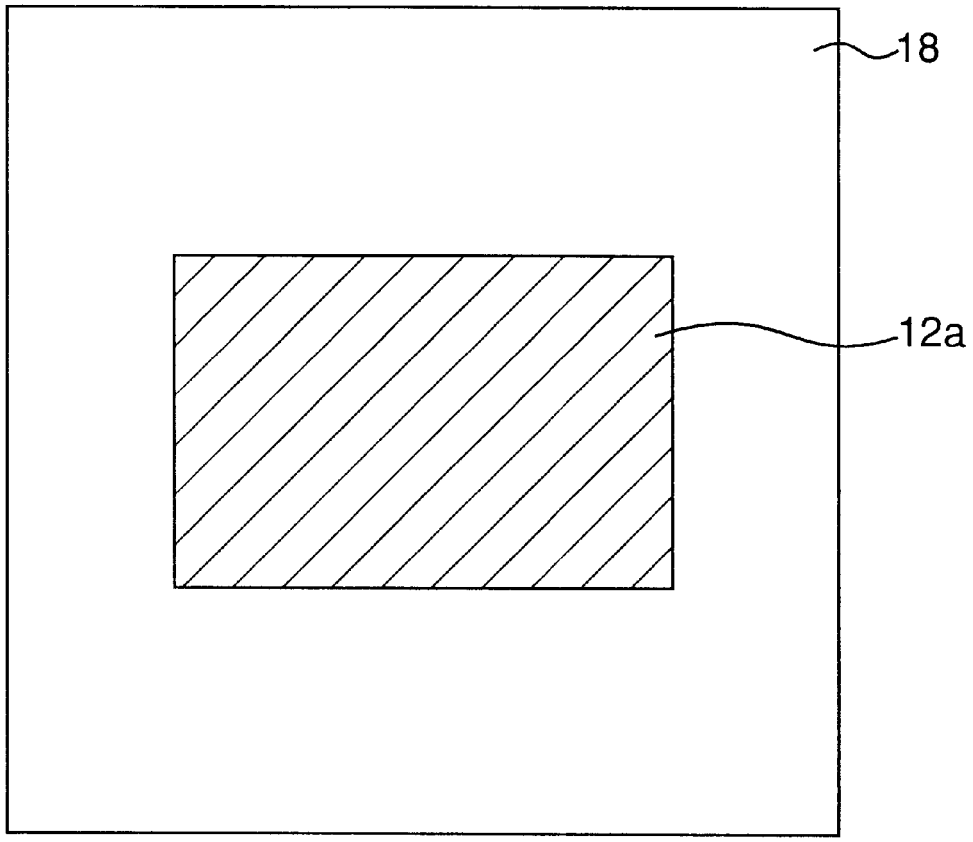
FIG. 16 is a plan view showing a configuration of a patch antenna apparatus of a first modified preferred embodiment according to the present invention.

FIG. 16 is a plan view showing a configuration of a patch antenna apparatus of a first modified preferred embodiment according to the present invention. In the above-mentioned present preferred embodiment, the patch antenna apparatus is constructed by using square-shaped conductor patches 12, 21, and 22. The present invention is not limited to this. As shown in FIG. 16, the patch antenna apparatus can be constructed by using rectangular-shaped conductor patches.

The patch antenna apparatus constructed by using a rectangular conductor patch is characterized in that, for example, the projection directional pattern of the projection radio wave from that of the conductor patch can be changed. Description will be made on the basis of the prior art patch antenna apparatus. In a conductor patch of a rectangular shape, when the length of one side in the resonance direction (in the X direction) is constant and the length of one side in the direction (in the Y direction) perpendicular to the resonance direction changes, the projection directional pattern on the plane parallel to the ZY plane changes. Specifically, when one side in the direction (in the Y direction) perpendicular to the resonance direction becomes longer, the projection directional pattern becomes narrower in the Y direction, and the gain thereof increases in the Y direction. Although the projection directional pattern of the plane parallel to the X-axis does not change, the gain thereof changes according to the change in gain in the Y direction. That is, in this case, the gain thereof increases on the ZX plane. On the contrary, when one side in the direction (in the Y direction) perpendicular to the resonance direction becomes shorter, the projection directional pattern is widened on the ZY plane, and the gain thereof decreases in the Z direction. In a manner similar to above, although the projection directional pattern of the plane parallel to the X-axis does not change, the gain thereof changes according to the change in gain in the Y direction. That is, in this case, the gain thereof on the ZX plane decreases. On the contrary, when one side in the direction (in the Y direction) perpendicular to the resonance direction is shortened, the projection directional pattern is widened in the ZY plane, and the gain thereof decreases in the Z direction.

In other words, in a rectangular-shaped conductor patch, when a length of one side in the resonance direction (X direction) is constant and a length of one side in the direction (Y direction) perpendicular to the resonance direction changes, only the gain thereof can be changed without changing the projection directional pattern of the ZX plane parallel to the resonance direction.

Figure 32:
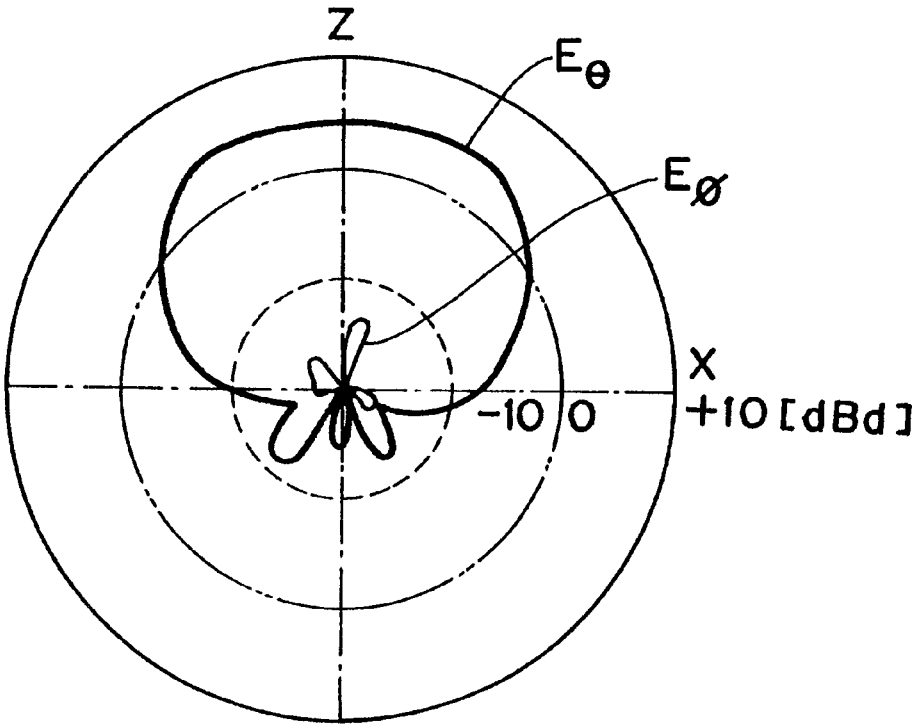
Fig.32 PRIOR ART
FIG. 32 is a pattern diagram showing a projection directional pattern on the Z-X plane of the patch antenna apparatus of FIG. 29.

Also, in a rectangular-shaped conductor patch, when a length of one side in the resonance direction (X direction) changes and a length of one side in the direction (Y direction) perpendicular to the resonance direction is constant, the projection directional pattern of the plane parallel to the ZX plane changes. When the length of one side in the resonance direction changes, generally speaking, the resonance frequency changes. In the case of an ordinary conductor patch, however, also when the length of one side in the resonance direction is integer times of half the wavelength, resonance is produced. It will be called hereinbelow that the resonance state when the length of one side in the resonance direction is half the wavelength is called a fundamental mode, the resonance state when the length of one side in the resonance direction is one wavelength is called a twice or second harmonic mode, the resonance state when the length of one side in the resonance direction is 3/2 wavelengths is called a triple or third harmonic mode. When this resonance state changes, the projection directional pattern of the plane parallel to the X-axis which is parallel to the resonance direction changes. For example, although the projection directional pattern of the ZX plane is large in the Z direction in the projection directional pattern of the ZX plane of FIG. 32 in the fundamental mode as shown by a solid line, it is null (zero or an extremely small value) pattern in the Z direction in the twice harmonic mode.

That is, by changing the length of one side perpendicular to the resonance direction of the rectangular conductor patch, the gain of the projection directional pattern of the plane parallel to the resonance direction can be changed. By changing the length of one side parallel to the resonance direction, therefore, the resonance state is changed, and the projection directional pattern of the plane parallel to the resonance direction can be changed. As mentioned above, by using the rectangular conductor patch, the projection directional pattern of a single conductor patch can be changed. When the array antenna apparatus is constructed by a plurality of conductor patches like the patch antenna apparatus according to the present invention, in particular in the case where the projection directional pattern of the conductor patch which is a component of the array antenna apparatus becomes various kinds, an antenna having a desired projection directional pattern can be realized in various environment. In the case of a single conductor patch, an antenna capable of obtaining the projection directional pattern which is closer to a desired projection directional pattern is realized.

Figure 17:
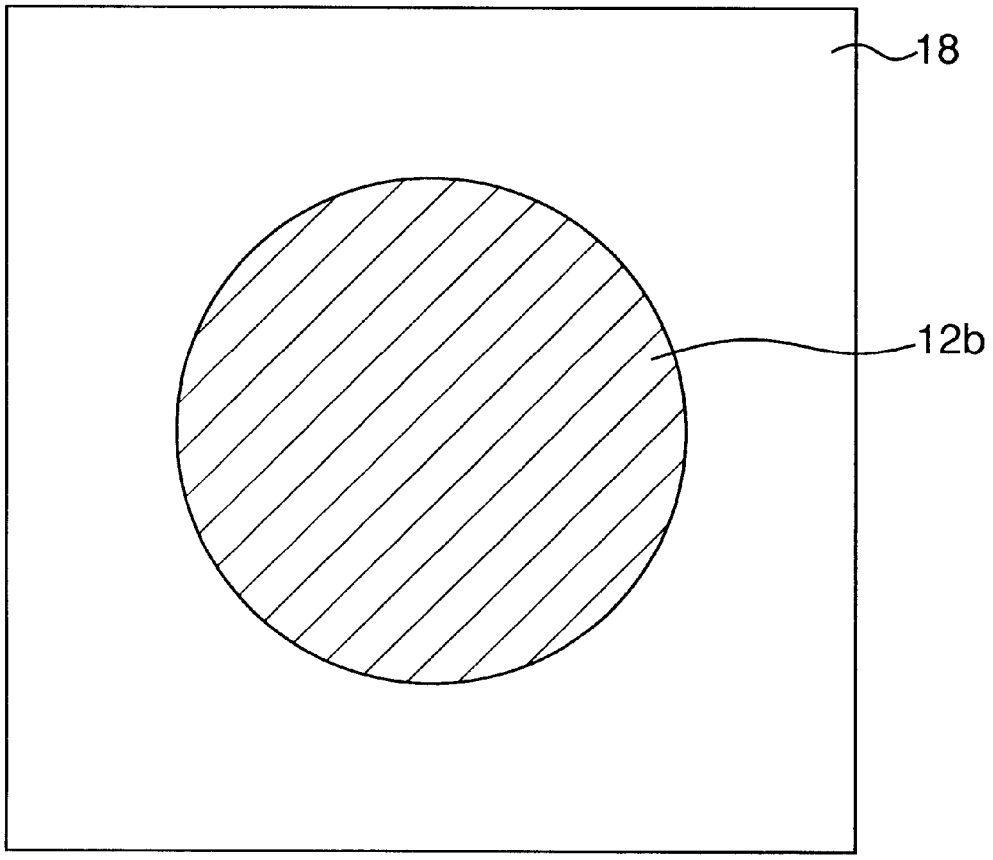
FIG. 17 is a plan view showing a configuration of a patch antenna apparatus of a second modified preferred embodiment according to the present invention.

FIG. 17 is a plan view showing a configuration of a patch antenna apparatus of a second modified preferred embodiment according to the present invention. In the above-mentioned present preferred embodiments, the patch antenna apparatus is constructed by using the square-shaped conductor patches 12, 21, and 22. The present invention is not limited to this, and a patch antenna apparatus can be also constructed by using a circular patch having a circular shape as shown in FIG. 17.

Although each of the feeding transmission lines 15, 16, 25, and 26 is constituted by a coaxial cable in the foregoing preferred embodiments, the present invention is not limited to this. A microstrip line formed on the dielectric substrate or a microstrip line formed in a multi-layer dielectric substrate may be also used.

In the above-mentioned present preferred embodiments, although the operation of the transmission antenna apparatus has been mainly described, the patch antenna apparatus according to the present invention is a bi-directional reversible circuit apparatus, and can be also used as a receiving antenna apparatus.

PREFERRED EXAMPLES

First Preferred Example

Figure 18:
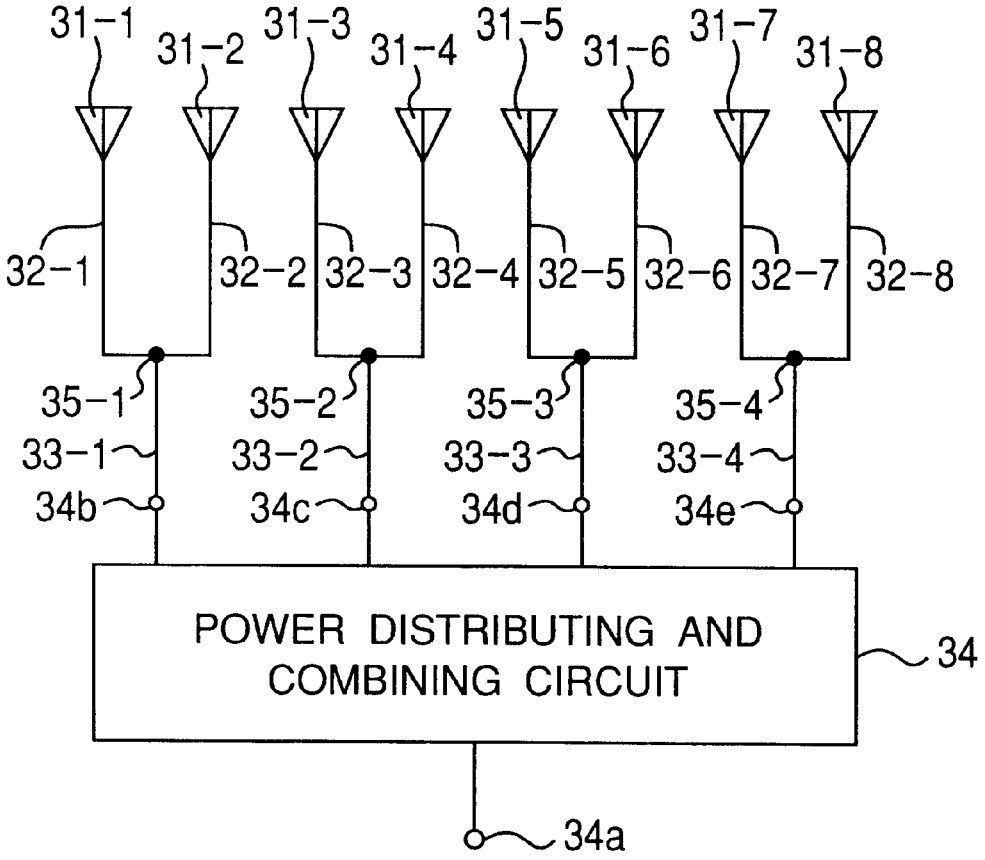
FIG. 18 is a block diagram showing a configuration of a patch antenna apparatus of a first preferred example according to the present invention.
Figure 19:
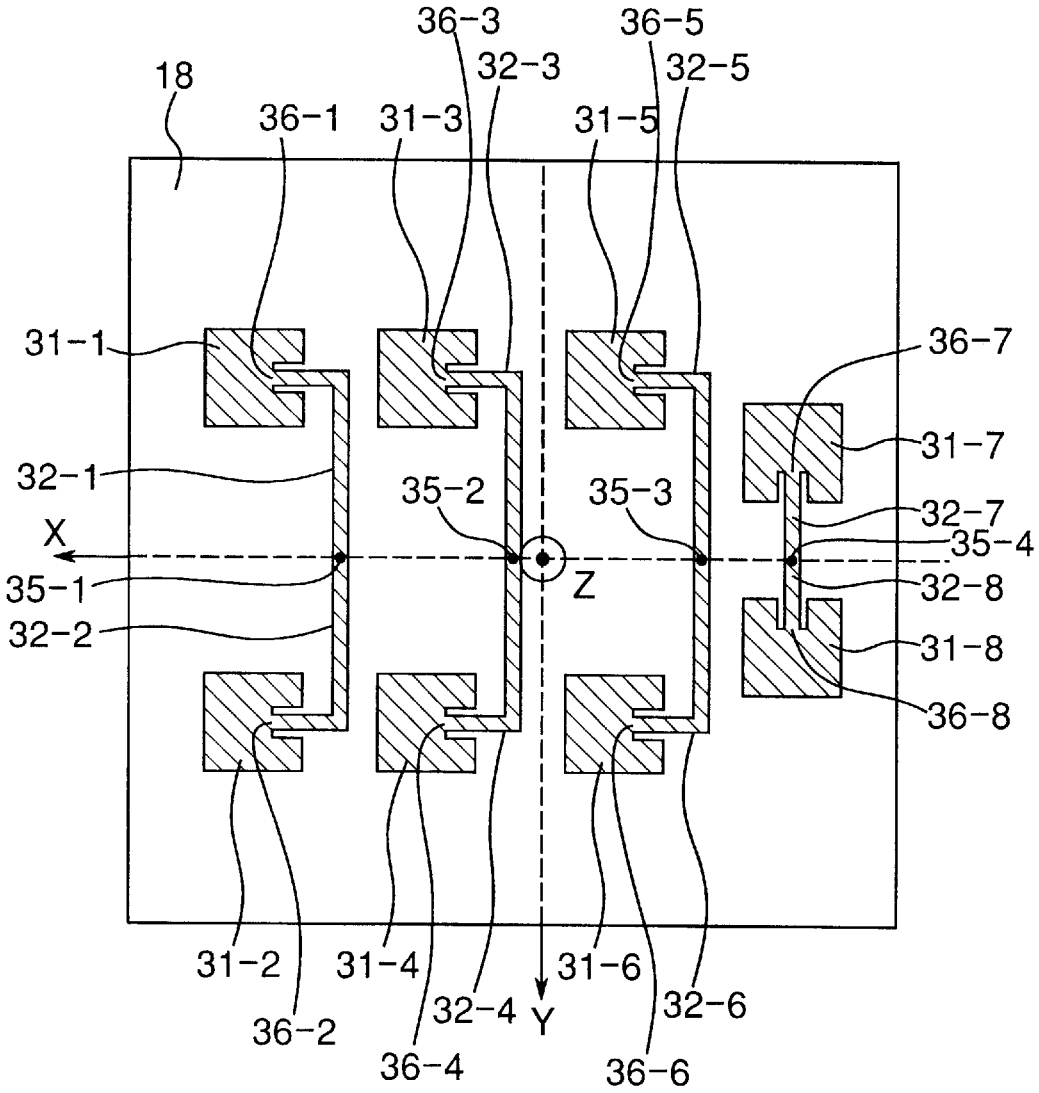
FIG. 19 is a plan view showing a configuration of a top surface of the patch antenna apparatus of FIG. 18.
Figure 20:
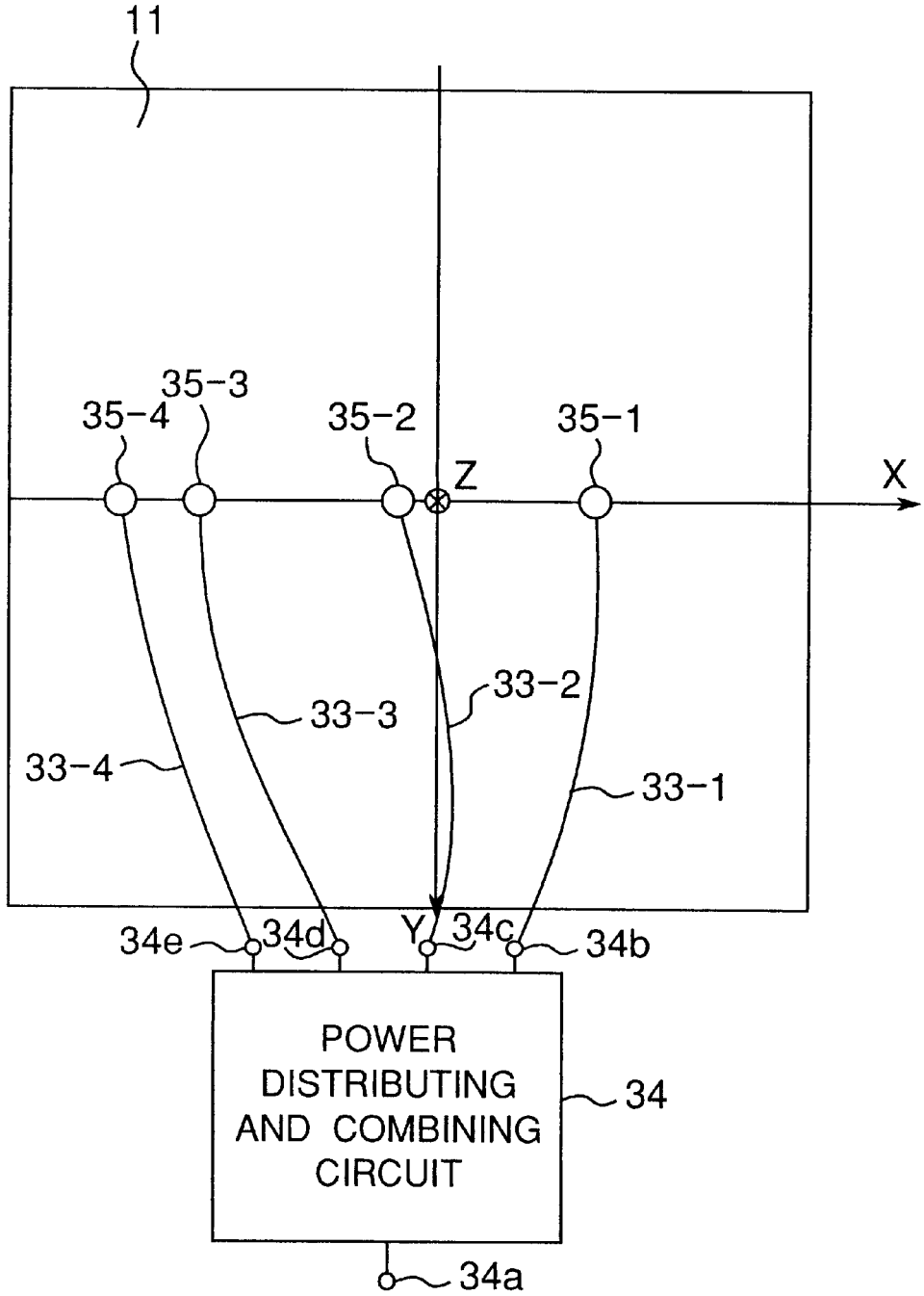
FIG. 20 is a plan view showing a configuration of a bottom surface of the patch antenna apparatus of FIG. 18.

FIG. 18 is a block diagram showing a configuration of a patch antenna apparatus of a first preferred example according to the present invention. FIG. 19 is a plan view showing a configuration of a top surface of the patch antenna apparatus of FIG. 18. FIG. 20 is a plan view showing a configuration of a bottom surface of the patch antenna apparatus of FIG. 18.

Referring to FIG. 18, the patch antenna apparatus of the first preferred example has eight conductor patches 31-l to 31-8. In this case, the conductor patch 31-1 is connected to a through-hole conductor 35-1 via a microstrip line 32-1, the conductor patch 31-2 is connected to the through-hole conductor 35-1 via a microstrip line 32-2. Also, the conductor patch 31-3 is connected to a through-hole conductor 35-2 via a microstrip line 32-3, and the conductor patch 31-4 is connected to the through-hole conductor 35-2 via a microstrip line 32-4 Further, the conductor patch 31-5 is connected to a through-hole conductor 35-3 via a microstrip line 32-5, and the conductor patch 31-6 is connected to the through-hole conductor 35-3 via a microstrip line 32-6. Still further, the conductor patch 31-7 is connected to a through-hole conductor 35-4 via a microstrip line 32-7, and the conductor patch 31-8 is connected to the through-hole conductor 35-4 via a microstrip line 32-8.

Generally speaking, a microstrip line is formed by a microstrip conductor and the grounding conductor 11 which sandwich the dielectric substrate 18. In the present specification, for convenience of explanation, a microstrip conductor formed on the dielectric substrate 18 is called a microstrip line.

The through-hole conductor 35-1 is connected to a terminal 34*b* of a power distributing and combining circuit 34 through a feeding transmission line 33-1 which is of a coaxial cable. The through-hole conductor 35-2 is connected to a terminal 34*c* of the power distributing and combining circuit 34 through a feeding transmission line 33-2 which is of a coaxial cable. The through-hole conductor 35-3 is connected to a terminal 34*d* of the power distributing and combining circuit 34 through a feeding transmission line 33-3 which is of a coaxial cable. The through-hole conductor 35-4 is connected to a terminal 34*e* of the power distributing and combining circuit 34 through a feeding transmission line 33-4 which is of a coaxial cable. In the power distributing and combining circuit 34, a radio signal, the power of which is to be distributed, is inputted to a terminal 34*a*, and the power of the radio signal is distributed, then the respective power-distributed radio signals are outputted from the terminals 34*b*, 34*c*, 34*d*, and 34*e*. On the other hand, radio signals supplied to the terminals 34*b*, 34*c*, 34*d*, and 34*e* are subjected to power combining, and then, a resultant signal is outputted from the terminal 34*a*.

Referring to FIG. 19, the square-shaped conductor patches 31-1 and 31-2 having feeding points 36-1 and 36-2 parallel to the X-axis are formed so as to be line-symmetrical with respect to the X-axis. For the purpose of impedance matching between the antenna element and the transmission line, the feeding point 36-1 of the conductor patch 31-1 is positioned on the inside of the conductor patch other than one side which is the resonance end of the conductor patch 31-1, and is connected to one end of the microstrip line 32-1, while another end of the microstrip line 32-1 is connected to the through-hole conductor 35-1. In a manner similar to that of above, the feeding point 36-2 of the conductor patch 31-2 is positioned on the inside of the conductor patch 31-2 other than one side which is the resonance end of the conductor patch 31-2, and is connected to one end of the microstrip line 32-2, while another end of the microstrip line 32-2 is connected to the through-hole conductor 35-1.

Further, the conductor patches 31-3, 31-4 and microstrip lines 32-3, 32-4, and the conductor patches 31-5, 31-6 and microstrip lines 32-5, 32-6 are formed in a manner similar to those of the conductor patches 31-1, 31-2 and microstrip lines 32-1, 32-2. In this case, the feeding points 36-1 to 36-6 are located at positions deviated from the center of the conductor patches 31-1 to 31-6 toward the -X direction of the X-axis, respectively, so as to produce resonance in parallel to the X-axis.

The square-shaped conductor patches 31-7 and 31-8 having feeding points 36-7 and 36-8 parallel to the Y-axis are formed so as to be line-symmetrical with respect to the X-axis. For the purpose of impedance matching between the antenna element and the transmission line, the feeding point 36-7 of the conductor patch 31-7 is positioned on the inside of the conductor patch other than one side which is the resonance end of the conductor patch 31-7, and is connected to one end of the microstrip line 32-7, while another end of the microstrip line 32-7 is connected to the through-hole conductor 35-4. In a manner similar to that of above, the feeding point 36-8 of the conductor patch 31-8 is positioned on the inside of the conductor patch 31-8 other than one side which is the resonance end of the conductor patch 31-8, and is connected to one end of the microstrip line 32-8, while another end of the microstrip line 32-8 is connected to the through-hole conductor 35-4. In this case, in order to produce resonance in parallel to the Y-axis, the feeding points 36-7 and 36-8 are located at positions deviated in the Y-axis direction from the center of the conductor patches 31-7 and 31-8, respectively, and oppose each other so as to sandwich the X-axis therebetween.

Referring to FIG. 20, the through-hole conductor 35-1 is connected to the terminal 34*b* of the power distributing and combining circuit 34 via the feeding transmission line 33-1 which is of a coaxial cable. The through-hole conductor 35-2 is connected to the terminal 34*c* of the power distributing and combining circuit 34 via the feeding transmission line 33-2 which is of a coaxial cable. The through-hole conductor 35-3 is connected to the terminal 34*d* of the power distributing and combining circuit 34 via the feeding transmission line 33-3 which is of a coaxial cable. The through-hole conductor 35-4 is connected to the terminal 34*e* of the power distributing and combining circuit 34 via the feeding transmission line 33-4 which is of a coaxial cable.

In the patch antenna apparatus of FIGS. 18 to 20, the relative dielectric constant of the dielectric substrate 18 is set to 2.6. Also, the length in the resonance direction of each of the conductor patches 31-1 to 31-8 is set to a length of 0.4 to 0.6 times the wavelength on the basis of the wavelength in which the dielectric constant of the dielectric substrate 18 is taken into consideration. More preferably, it is set to a length of 0.5 times the wavelength.

Figure 21:
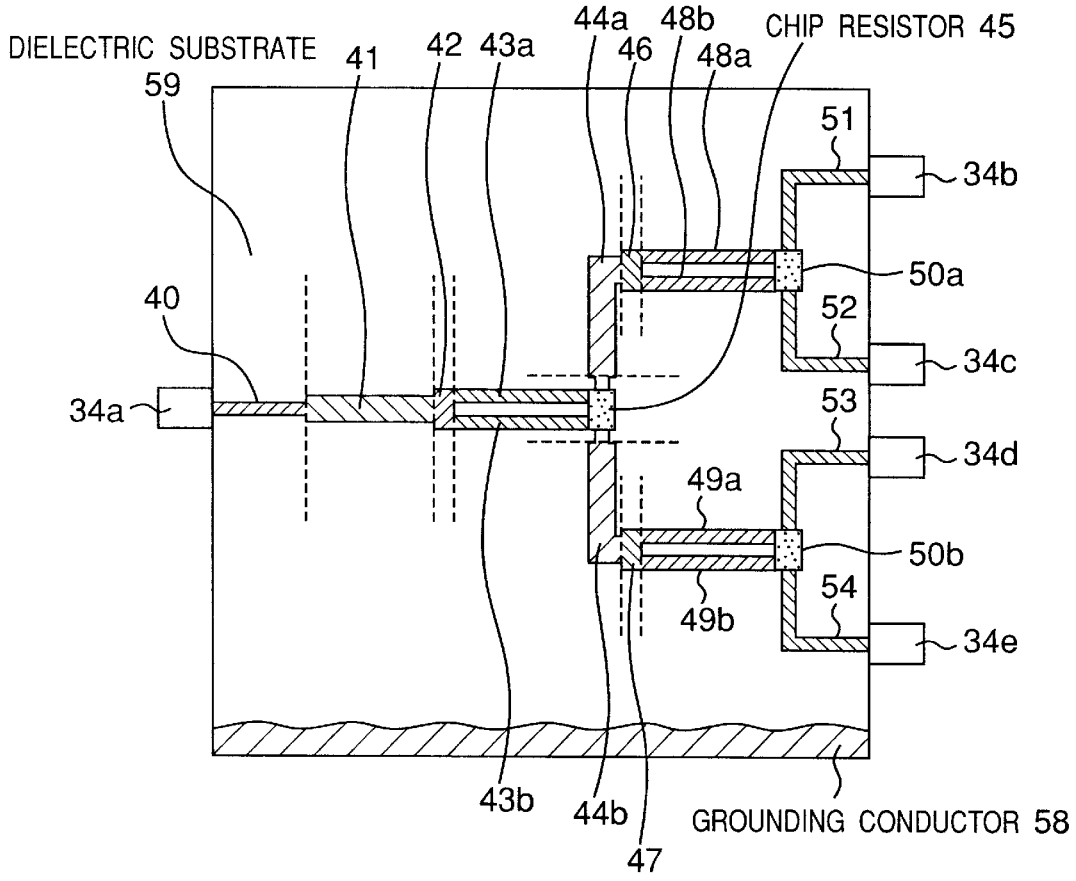
FIG. 21 is a partially broken plan view showing a configuration of a power distributing and combining circuit of FIG. 18.

FIG. 21 is a partially broken plan view showing a configuration of the power distributing and combining circuit 34 of FIG. 18. Referring to FIG. 21, microstrip lines 40, 41, 42, 43*a*, 43*b*, 44*a*, 44*b*, 46, 47, 48*a*, 48*b*, 51, 52, 53, and 54 and chip resistors 45, 50*a* and 50*b* are formed as follows on a dielectric substrate 59 having a bottom surface thereof on which a grounding conductor 58 is formed.

The terminal 34*a* is connected to the microstrip line 42 via the two microstrip lines 40 and 41 which are connected in series. One end in the width direction at the right-side end part of the microstrip line 42 is connected to one end of the chip resistor 45 via the microstrip line 43*a*, and another end in the width direction at the right-side end part of the microstrip line 42 is connected to another end of the chip resistor 45 via the microstrip line 43*b*. One end of the chip resistor 45 is connected to the microstrip line 46 via the microstrip line 44*a*, and another end of the chip resistor 45 is connected to the microstrip line 47 via the microstrip line 44*b*.

Also, one end in the width direction at the right-side end part of the microstrip line 46 is connected to one end of the chip resistor 50*a* via the microstrip line 48*a*, and another end in the width direction at the right-side end part of the microstrip line 46 is connected to another end of the chip resistor 50*a* via the microstrip line 48*b*. Further, one end of the chip resistor 50*a* is connected to the terminal 34*b* via the microstrip line 51, and another end of the chip resistor 50*a* is connected to the terminal 34*c* via the microstrip line 52.

Also, one end in the width direction at the right-side end part of the microstrip line 47 is connected to one end of the chip resistor 50*b* via the microstrip line 49*a*, and another end in the width direction at the right-side end part of the microstrip line 47 is connected to another end of the chip resistor 50*b* via the microstrip line 49*b*. Further, one end of the chip resistor 50*b* is connected to the terminal 34*d* via the microstrip line 53, and another end of the chip resistor 50*b* is connected to the terminal 34*e* via the microstrip line 54.

In the preferred example of FIG. 21, the characteristic impedance of each of the microstrip lines 40, 43*a*, 43*b*, 48*a*, 48*b*, 49*a*, 49*b*, 51, 52, 53, and 54 is 50Ω. The characteristic impedance of each of the microstrip lines 41, 44*a*, and 44*b* is $25\sqrt{2}\Omega$. The characteristic impedance of each of the microstrip lines 42, 46, and 47 is 25Ω. In this case, each of the microstrip lines 41, 43*a*, 43*b*, 48*a*, and 48*b* has an electric wavelength of a quarter of the wavelength in which the dielectric constant of the dielectric substrate 59 is taken into consideration. Further, a resistance value of each of the chip resistors 45, 50*a*, and 50*b* is 100Ω, and the relative dielectric constant of the dielectric substrate 59 is about 10.

The power distributing and combining circuit 34 constructed as shown in FIG. 21 has a distribution ratio of 1:4, and is constituted by cascade-connecting two Wilkinson type power distributing and combining circuits of 1:2. In this case, the dielectric substrate 59 having a high relative dielectric constant is used here to reduce the size of the circuit. On the other hand, generally speaking, in order to maintain the same characteristic impedance, the line width of the microstrip line has to be narrowed as the relative dielectric constant of the dielectric substrate becomes higher. As an example, in the case of a frequency of 2 GHz, when the thickness of the dielectric substrate 59 is 1 mm and the relative dielectric constant is 10, the line width of the microstrip line is as follows. The width of the line having a characteristic impedance of 25Ω is about 3 mm, that having a characteristic impedance of 50Ω is about 1 mm, and that having a characteristic impedance of 100Ω is about 0.14 mm. It is therefore desirable from the viewpoint of manufacture and accuracy that the power distributing and combining circuit 34 is formed by a microstrip line whose resistance value is 50Ω or smaller. Also, the chip resistors 45, 50*a*, and 50*b* are provided to improve isolation among the branched microstrip lines. In the power distributing and combining circuit 34 constructed as mentioned above, the characteristic impedance of each of the terminals 34*a* to 34*e* is 50Ω. The power distributing and combining circuit having very excellent power equally distributing characteristic, the same phase distributing characteristic, the terminal reflecting characteristic, isolation characteristic, and the like can be realized.

The operation of the patch antenna apparatus having the configuration shown in FIGS. 18 to 21 will be hereinafter described.

In the preferred example, as shown in FIG. 19, conductor patches which resonate in parallel with the X-axis are six conductor patches 31-1 to 31-6, and conductor patches which resonate in parallel with the Y-axis are two conductor patches 31-7 and 31-8. Radio signals having the same powers are supplied to the conductor patches 31-1 to 31-8, respectively. Consequently, the ratio of the power fed to the set of the conductor patches 31-1 to 31-6 which resonate in parallel with the X-axis, to the power fed to the set of the conductor patches 31-7 and 31-8 which resonate in parallel with the Y-axis is 3:1. Among the six conductor patches 31-1 to 31-6 which resonate in parallel with the X-axis, the three conductor patches 31-1, 31-3, and 31-5 constitutes a one-dimensional array antenna apparatus parallel to the X-axis, and the rest of the three conductor patches 31-2, 31-4, and 31-6 also constitutes a one-dimensional array antenna apparatus parallel to the X-axis. The two sets of the one-dimensional array antenna apparatuses are formed so as to be line-symmetrical to each other with respect to the X-axis.

In the present preferred embodiment, by changing the electric length of each of the feeding transmission lines 33-1 to 33-4 each of a coaxial cable, the phase of the radio signal to each of the conductor patches 31-1 to 31-8 is changed. In this case, a phase difference is caused among the radio signals fed to the three conductor patches 31-1, 31-3, and 31-5 as mentioned as follows. When the phase of the radio signal fed to the conductor patch 31-3 positioning in the center is zero degree of a reference phase, the phase of the radio signal fed to each of the conductor patches 31-1 and 31-5 located at both ends is set to 180degrees. Also, in a manner similar to that of the phase differences of the power supply of the one-dimensional array antenna apparatus constructed by the conductor patches 31-1, 31-3, and 31-5, the power is fed with the phase difference to the one-dimensional array antenna apparatus constructed by the conductor patches 31-2, 31-4, and 31-6. It is to be noted that the distance between the midpoints in the X-axis direction of adjacent two conductor patches among the three conductor patches 31-1, 31-3, and 31-5 constructing the one-dimensional array antenna apparatus which is parallel to the X-axis is set to 0.38 times the wavelength on the basis of the free space wavelength. The distance between the midpoints of two conductor patches (31-1 and 31-2, 31-3 and 31-4, and 31-5 and 31-6) which are line-symmetrical with respect to the X-axis is set to 0.7 times the wavelength. Also, the distance between the midpoints of the one-dimensional array antenna apparatus constructed by the conductor patches 31-2, 31-4, and 31-6 is set in a manner similar to that of above. Further, in the two sets of the one-dimensional array antenna apparatuses, the radio signals of the same phase are fed to each pair of two conductor patches arranged line so as to be line-symmetrical to each other. That is, radio signals of the same phase are fed to the two conductor patches 31-1 and 31-2, radio signals of the same phase are fed to the two conductor patches 31-3 and 31-4, and radio signals of the same phase are fed to the two conductor patches 31-5 and 31-6.

Also, the two conductor patches 31-7 and 31-8 which resonate in parallel with the Y-axis are disposed in parallel with the Y-axis, and are arranged at positions so as to be line-symmetrical with respect to the X-axis, then radio signals of opposite phases are fed to the two conductor patches 31-7 and 31-8. In this case, the distance between the midpoints of the adjacent conductor patches 31-7 and 31-8 is set to 0.6 times the wavelength on the basis of the wavelength in which the dielectric constant of the dielectric substrate 18 is taken into consideration. Further, when the phase of the radio signal fed to the conductor patch 31-3 is set to zero degree of a reference phase, the phases of the radio signals fed to the conductor patches 31-7 and 31-8 are 90 degrees and 270 degrees, or 270 degrees and 90 degrees, respectively.

In the preferred example, the power is fed to the conductor patches 31-1 to 31-8 by using the microstrip lines 32-1 to 32-8 formed on the same plane, on which the conductor patches 31-1 to 31-8 are formed, and the feeding transmission lines 33-1 to 33-4 each of a coaxial cable. The characteristic impedance of each of the microstrip lines 32-1 to 32-8 used in the present preferred embodiment is set to 100Ω, and the characteristic impedance of each of the coaxial cables used as the feeding transmission lines 33-1 to 33-4 is set to 50Ω. By feeding the power to the conductor patches 31-1 to 31-6 which resonate in parallel with the X-axis in the same direction from −X to +X, the radio signals of the same phase are fed to the conductor patches 31-1 to 31-6. On the other hand, by feeding the power in parallel to the Y-axis and from the opposite directions to the two conductor patches 31-7 and 31-8 which resonate in parallel with the Y-axis, the radio signals of the opposite phases are fed to the two conductor patches 31-7 and 31-8, respectively.

Figure 22:
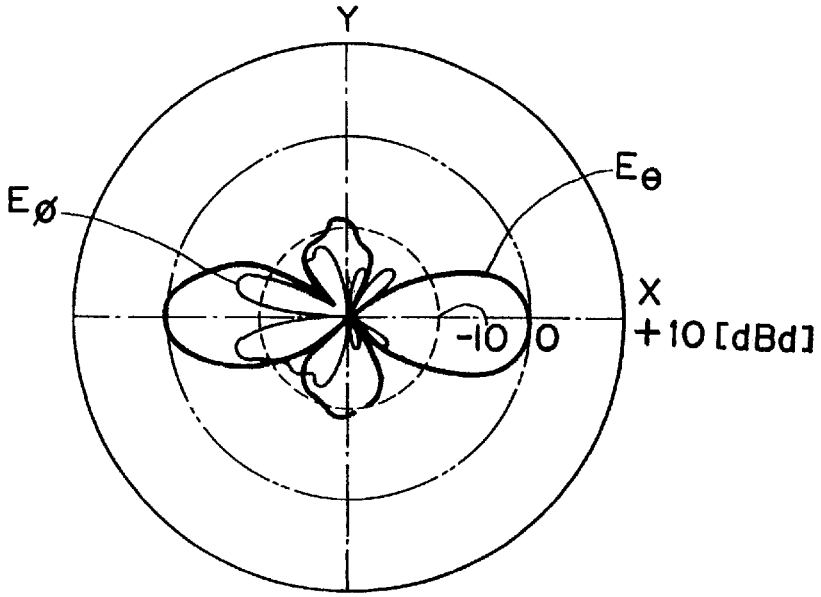
FIG. 22 is a pattern diagram showing a projection directional pattern on the X-Y plane of the patch antenna apparatus of FIG. 18.
Figure 23:
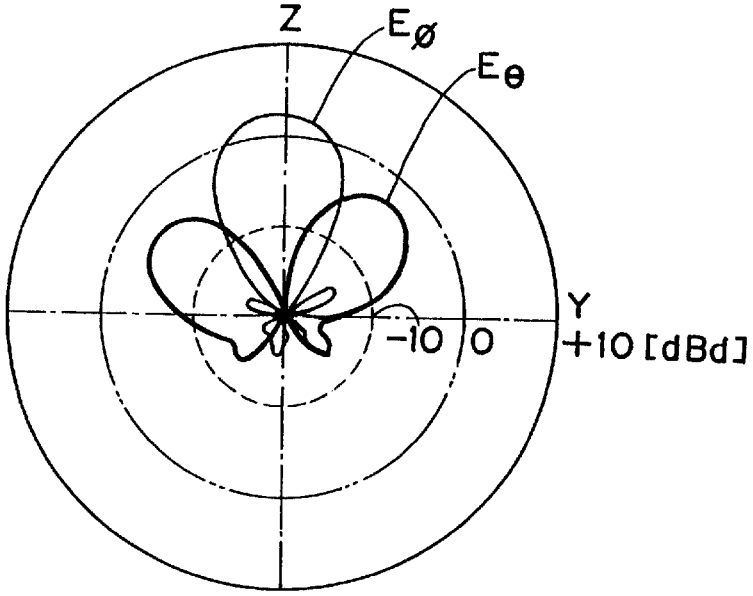
FIG. 23 is a pattern diagram showing a projection directional pattern on the Z-Y plane of the patch antenna apparatus of FIG. 18.
Figure 24:
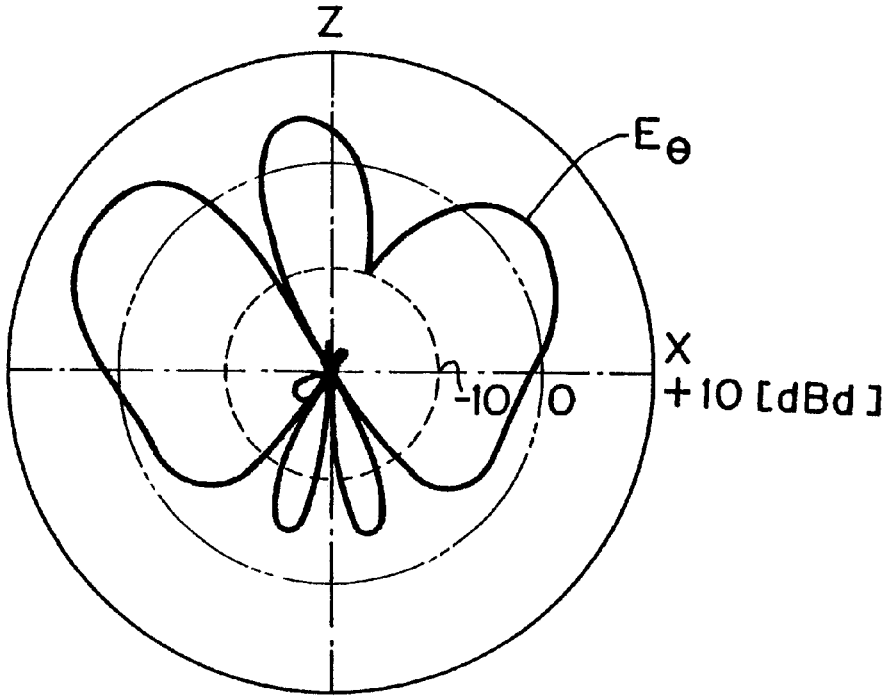
FIG. 24 is a pattern diagram showing a projection directional pattern on the Z-X plane of the patch antenna apparatus of FIG. 18.

FIGS. 22 to 24 are pattern diagrams showing a projection directional pattern on each plane of the patch antenna apparatus of FIG. 18. Referring to FIGS. 22 to 24, a component $E_\theta$ in the θ direction of an electric field of a radio wave projected from the patch antenna apparatus (hereinafter, referred to as a θ component of the electric field), and a component $E_\phi$ in the ϕ direction of the electric field (hereinafter, referred to as a ϕ component of the electric field) are shown. The unit of each of these components is dBd, and is a gain when the projection power of a dipole antenna apparatus is used as a reference.

As apparent from FIGS. 22 to 24, the θ component $E_\theta$ of the electric field of the radio wave projected from the patch antenna apparatus of the preferred example is relatively large on the Z-X plane, and is relatively small on the Z-Y plane. The projection directional pattern on the Z-X plane of the θ component $E_\theta$ of the electric field of the radio wave is obtained by the projection from the six conductor patches which resonate in parallel with the X-axis. By causing a phase difference in the one-dimensional array antenna apparatus constituted by the three conductor patches 31-1, 31-3, and 31-5 which are parallel to the X-axis, the maximum projection direction is changed to the direction of a low elevation angle. The above one-dimensional array antenna apparatus and another one-dimensional array antenna apparatus constituted by another set of the three conductor patches 31-2, 31-4, and 31-6 which are parallel to the X-axis are disposed so as to be line-symmetrical to each other with respect to the X-axis, so that the radio signals of the same phase are fed thereto, thereby the beam width is narrowed in the Y-axis direction, and the gain thereof is increased.

Also, the projection directional pattern on the Z-Y plane of the θ component $E_\theta$ of the electric field is obtained by the projection of radio waves from the two conductor patches 31-7 and 31-8 which resonate in parallel with the Y-axis. By feeding radio signals of the opposite phases to the two conductor patches 31-7 and 31-8 which resonate in parallel with the Y-axis, respectively, the maximum projection direction is inclined from the Z-axis direction which is the front direction of the patch antenna apparatus toward the Y-axis direction. That is, according to the patch antenna apparatus of the preferred example, there can be projected radio waves of two linear polarizations which cross each other so as to be perpendicular to each other, where the radio waves include the linear polarization parallel to the X-axis and the linear polarization parallel to the Y-axis. Further, the radio wave of the linear polarization parallel to the X-axis is projected very strongly on the Z-X plane and with the maximum value in a direction of a low elevation angle, and the maximum projection direction of the linear polarization parallel to the Y-axis can be inclined from the Z-axis direction toward the Y-axis direction on the Z-Y plane. Therefore, in the case of reversely suspending the patch antenna apparatus of the preferred example from the ceiling of a very elongated space such as a corridor or the like, the radio wave can be projected in a broader projection area in a space such as a corridor.

In the foregoing preferred example, there is described the patch antenna apparatus in which the length in the resonance direction of each of the two conductor patches 31-7 and 31-8 which resonate in parallel with the Y-axis is set to 0.4 to 0.6 times the wavelength on the basis of the wavelength in which the dielectric constant of the dielectric substrate is taken into consideration. The present invention is not limited to this. The conductor patch which resonates in parallel with the Y-axis may be constructed by only one square-shaped conductor patch 31-7 whose one side has a length in the resonance direction of 0.8 to 1.2 times the wavelength. With the configuration, the characteristic impedance can be easily adjusted without deteriorating the projection directional pattern.

Although the patch antenna apparatus is constructed by using the conductor patches 31-1 to 31-8 each having each one feeding point 36-1 to 36-8, respectively, in the foregoing preferred example, the present invention is not limited to this. In a manner similar to that of the first preferred embodiment, a patch antenna apparatus may be also constructed by using the conductor patch 12 having two feeding points 13 and 14. Then, the number of conductor patches can be decreased, and it is advantageously effective to reduce the size of the patch antenna apparatus.

Second Preferred Example

Figure 25:
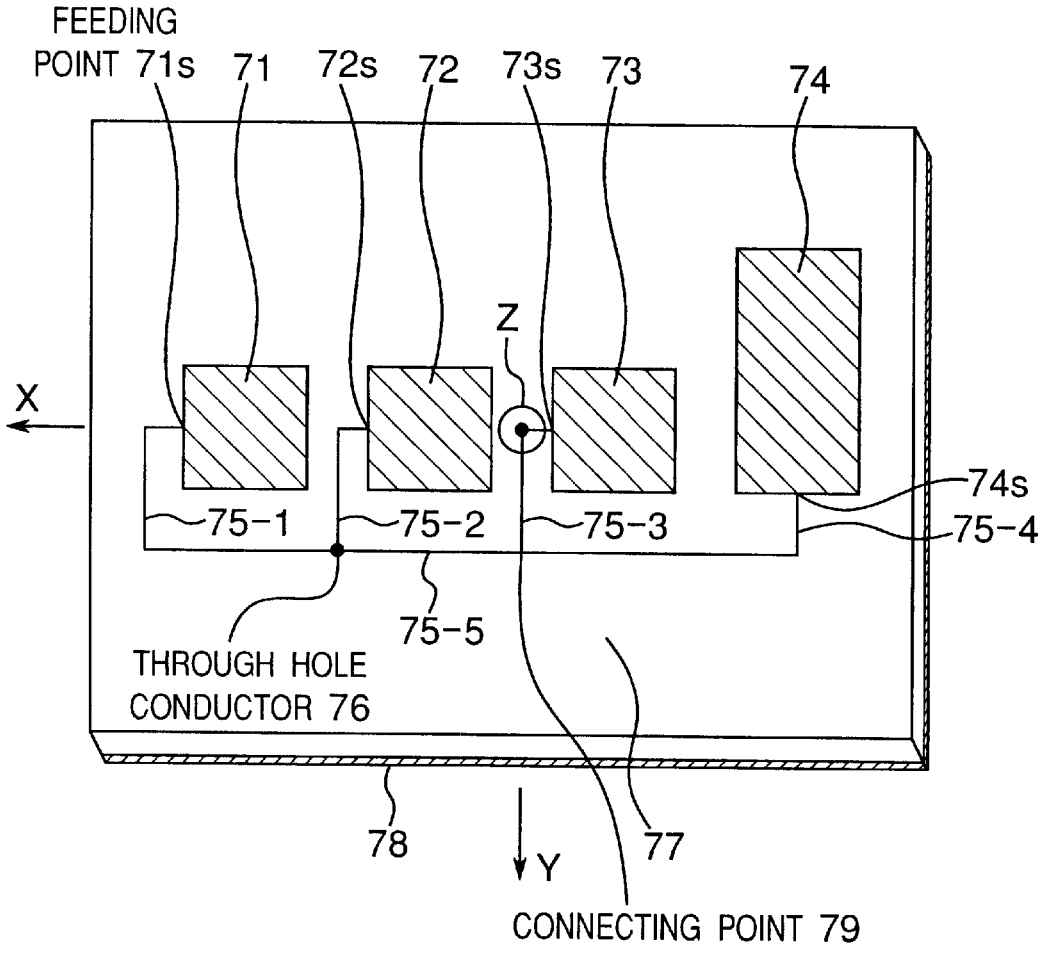
FIG. 25 is a perspective view showing a configuration of a patch antenna apparatus of a second preferred example according to the present invention.

FIG. 25 is a perspective view showing a configuration of the patch antenna apparatus of a second preferred example according to the present invention. The patch antenna apparatus according to the second preferred example is characterized bag integrally forming a power distributing and combining circuit by using three square-shaped conductor patches 71, 72, and 73 which resonate in parallel with the X-axis and one rectangular-shaped conductor patch 74 which resonates in parallel with the Y-axis.

Referring to FIG. 25, on a dielectric substrate 77 having a grounding conductor 78 formed on its bottom surface, the three square-shaped conductor patches 71, 72, and 73 which have feeding points 71*s*, 72*s*, and 73*s* at positions deviated from the center of the conductor patches in the X-axis direction and resonate in parallel with the X-axis, and the one rectangular-shaped conductor patch 74 which has a feeding point 74s in a position deviated from the center of the conductor patch in the Y-axis direction and resonates in parallel with the Y-axis are disposed along the X-axis. It is to be noted that the origin of the X-Y plane is positioned in the midpoint between the centers of the conductor patches 72 and 73, and the Z-axis direction is set to a direction of the thickness thereof from the grounding conductor 78 toward the dielectric substrate 77. Microstrip lines 75-1 to 75-5 for connecting a through-hole conductor 76 with the conductor patches 71, 72, 73, and 74 are formed on the dielectric substrate 77, and these microstrip lines 75-1 to 75-5 act as the power distributing and combining circuit.

The through-hole conductor 76 penetrates the dielectric substrate 77 in the thickness direction thereof, and is connected to a transmitter and receiver (not shown). The feeding point 71*s* of the conductor patch 71 is connected to the through-hole conductor 76 via the microstrip line 75-1, and the feeding point 72*s* of the conductor patch 72 is connected to the through-hole conductor 76 via the microstrip line 75-2. Also, the feeding point 73*s* of the conductor patch 73 is connected to the through-hole conductor 76 via the microstrip line 75-3, a connection point 79, and the microstrip line 75-5, and the feeding point 74s of the conductor patch 74 is connected to the through-hole conductor 76 via the microstrip line 75-4, a connection point 79, and the microstrip line 75-5.

It is to be noted that the relative dielectric constant of the dielectric substrate 77 is 2.6. The length in the resonance direction of each of the conductor patches 71 to 73 is set to 0.4 to 0.6 times the wavelength, more preferably, to 0.5 times the wavelength on the basis of the wavelength in which the dielectric constant of the dielectric substrate 77 is taken into consideration. The length in the resonance direction of the conductor patch 74 is set to 0.8 to 1.2 times the wavelength, more preferably, to one wavelength. The distance between the centers of adjacent two conductor patches among the three conductor patches 71, 72, and 73 which resonate in parallel with the X-axis is set to 0.38 times the wavelength on the basis of the free space wavelength.

The operation of the patch antenna apparatus according to the second preferred example constructed as mentioned above will be described hereinafter.

When radio signals of a predetermined resonance frequency are fed to the conductor patches 71 to 74 via the through-hole conductor 76, the conductor patches 71 to 73 resonate in parallel with the X-axis and the conductor patch 74 resonates in parallel with the Y-axis. In this case, the patch antenna apparatus of the present preferred example can project radio waves including two linear polarizations which cross each other so as to be perpendicular to each other, where the radio waves include a linear polarization parallel to the X-axis and a linear polarization parallel to the Y-axis at the equal resonance frequency.

For example, by changing the shape formed by the microstrip lines 75-1 to 75-5 in accordance with the shape in the horizontal direction of a space to be projected, a set of powers distributed to the conductor patches 71 to 73 which resonate in parallel with the X-axis and the power distributed to the conductor patch 74 which resonates in parallel with the Y-axis are made different from each other. Consequently, in accordance with the shape of the space to be projected, the powers of the two linear polarizations which cross each other so as to be perpendicular to each other can be optimally distributed. In other words, by distributing the power of the two linear polarizations which cross each other so as to be perpendicular to each other with a predetermined distribution ratio, a desired projection area can be realized.

Further, for example, by changing the electrical length or the like of the microstrip lines 75-1 to 75-5, a phase difference is given among the radio signals fed to the conductor patches 71 to 74. Thus, the phased array antenna apparatus or adaptive array antenna apparatus capable of changing the projection area in accordance with the shape of the space to be projected can be realized.

The microstrip lines 75-1 to 75-5 each of a feeding transmission line and the power distributing and combining circuit are formed on the dielectric substrate 77 on which the conductor patches 71 to 74 are also formed, and are integrally formed in the antenna apparatus, so that they are effective on reduction in size of the antenna apparatus.

More specifically, the patch antenna apparatus of FIG. 25 has the three conductor patches 71 to 73 each of a conductor patch which resonate in parallel with the X-axis, and one conductor patch 74 of a conductor patch which resonates in parallel with the Y-axis. In the preferred example, when radio signals of the equal power are fed to the conductor patches 71 to 74, the ratio of the power fed to the conductor patches 71 to 73 which resonate in parallel with the X-axis, to the power fed to the conductor patch 74 which resonates in parallel to the Y-axis is 3:1. The three conductor patches 71 to 73 which resonate in parallel with the X-axis constitutes a one-dimensional array antenna apparatus which is parallel to the X-axis.

In this case, a phase difference is given as described hereinafter among the radio signals fed to the conductor patches 71 to 74. That is, when the phase of the radio signal fed to the middle conductor patch 72 is zero degree of a reference phase, the phase of the radio signal fed to each of the other conductor patches 71 and 73 on both sides is 180 degrees. The phase of the radio signal fed to the conductor patch 74 which resonates in parallel with the Y-axis is 90 or 270 degrees when the phase of the radio signal fed to the conductor patch 72 is set to zero degree of a reference phase. The amplitude and phase of the radio signal fed to each of the conductor patches 71 to 74 are varied by changing the configuration of each of the microstrip lines 75-1 to 75-5.

Figure 26:
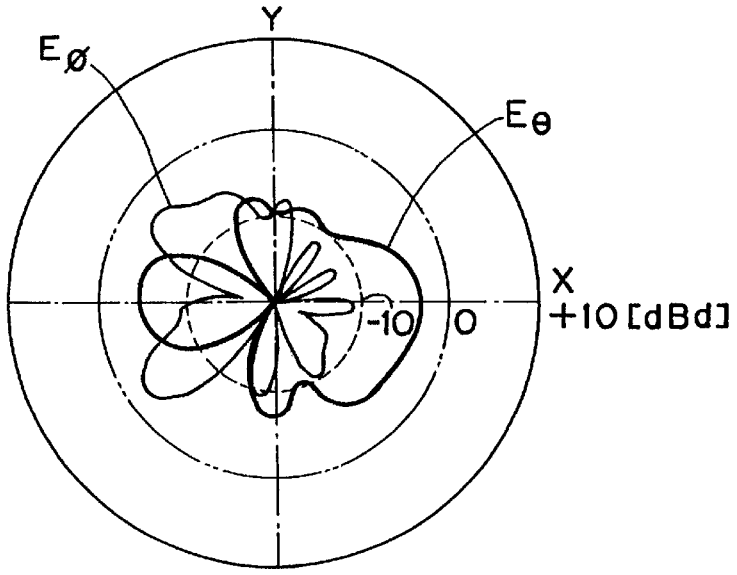
FIG. 26 is a pattern diagram showing a projection directional pattern on the X-Y plane of the patch antenna apparatus of FIG. 25.
Figure 27:
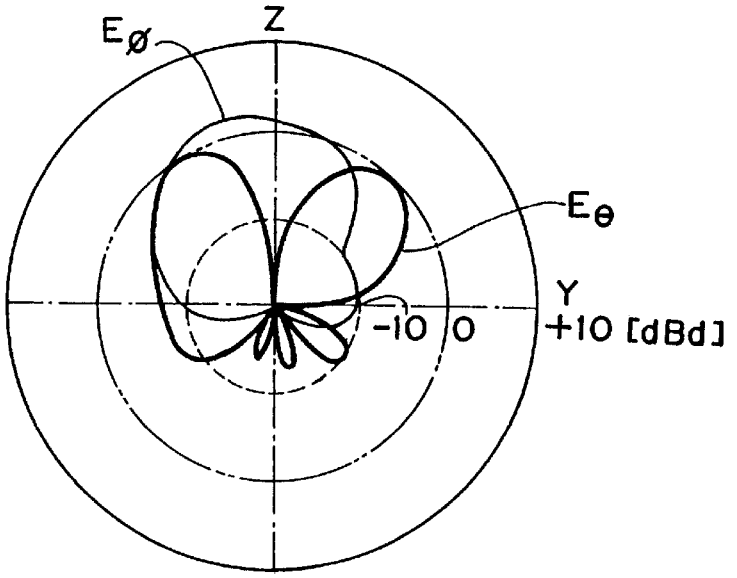
FIG. 27 is a pattern diagram showing a projection directional pattern on the Z-Y plane of the patch antenna apparatus of FIG. 25.
Figure 28:
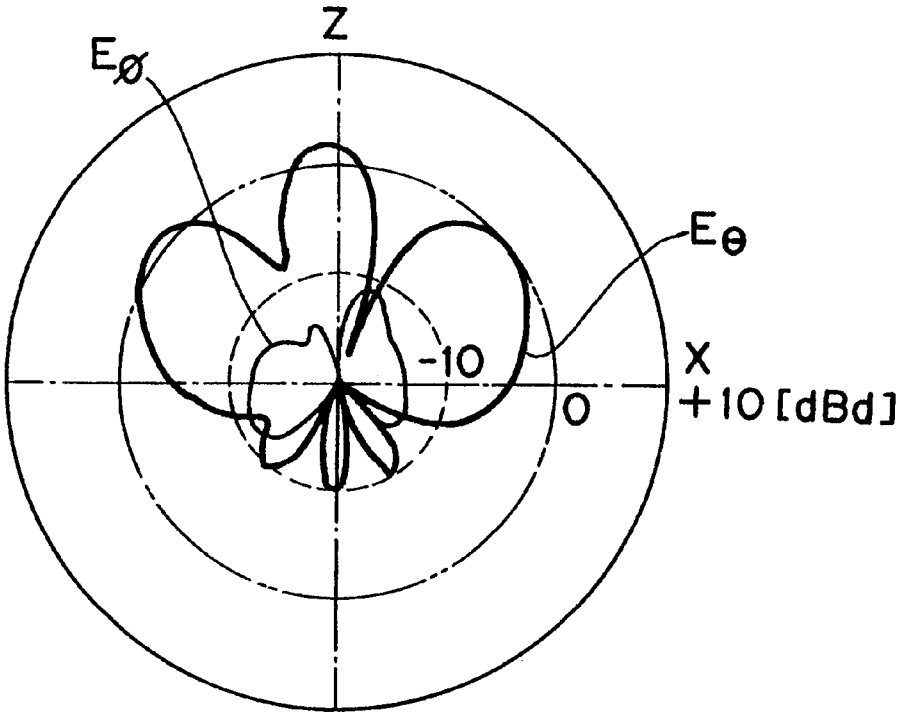
FIG. 28 is a pattern diagram showing a projection directional pattern on the Z-X plane of the patch antenna apparatus of FIG. 25.
Figure 29:
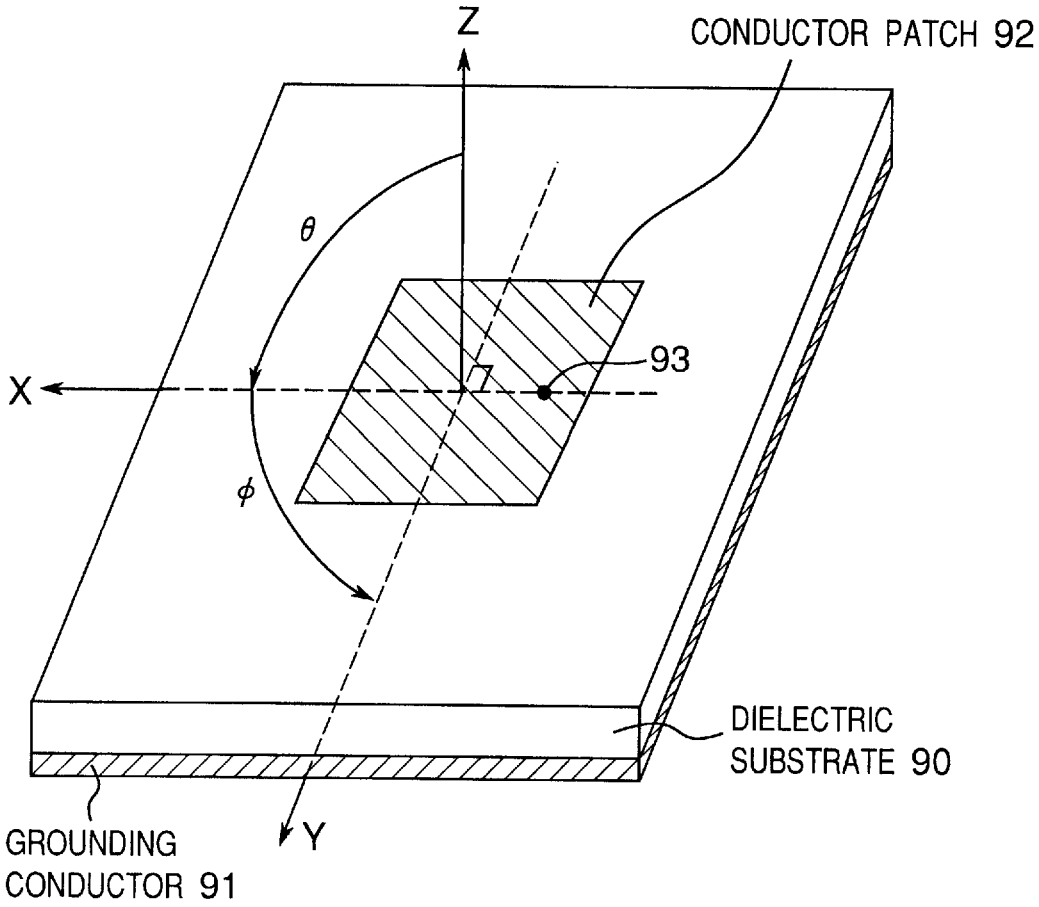
Fig.29 PRIOR ART
FIG. 29 is a perspective view showing a configuration of a prior art patch antenna apparatus.
Figure 30:
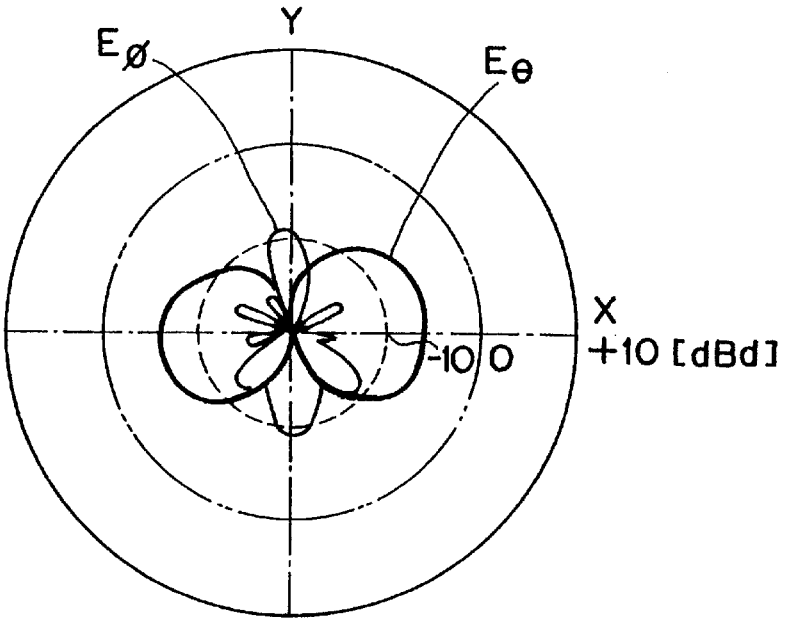
Fig.30 PRIOR ART
FIG. 30 is a pattern diagram showing a projection directional pattern on the X-Y plane of the patch antenna apparatus of FIG. 29.
Figure 31:
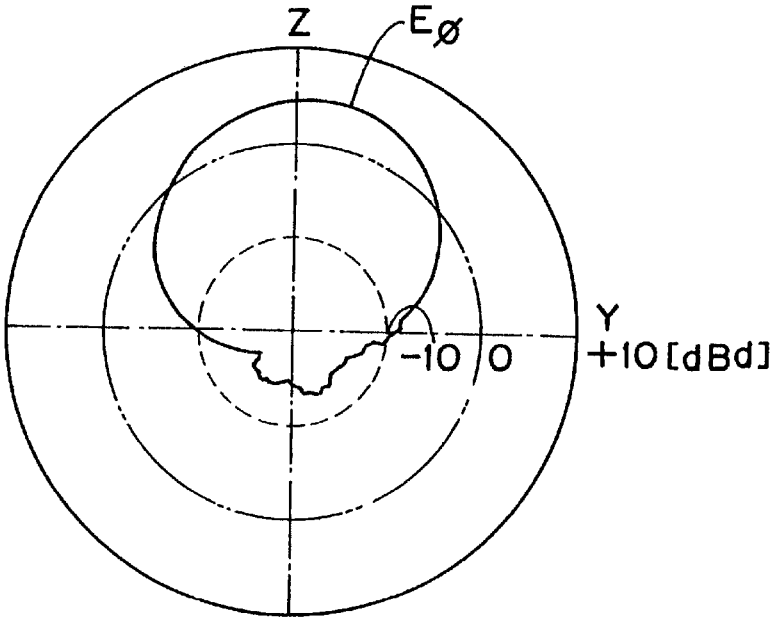
Fig.31 PRIOR ART
FIG. 31 is a pattern diagram showing a projection directional pattern on the Z-Y plane of the patch antenna apparatus of FIG. 29.

FIGS. 26 to 28 are pattern diagrams showing a projection directional pattern on each plane of the patch antenna apparatus of FIG. 25. The unit of each component of the electric field of the projection directional pattern is dBd, and is the gain when the projection power of the dipole antenna apparatus is used as a reference.

As apparent from FIGS. 26 to 28, the θ component $E_\theta$ of the electric field of the radio wave is relatively large in the projection directional pattern on the Z-X plane. This is because of the projection of radio waves from the three conductor patches 71 to 73 which resonate in parallel with the X-axis. By causing a phase difference in the one-dimensional array antenna apparatus formed by the three conductor patches 71 to 73 which are parallel with the X-axis, the maximum projection direction is changed toward the direction of a low elevation angle. Also, the θ component $E_\theta$ is relatively large in the projection directional pattern of the Z-Y plane due to the projection of the radio wave from the conductor patch 74 of one wavelength which resonates in parallel with the Y-axis. The maximum projection direction is inclined from the Z-axis direction which is the front direction of the antenna apparatus toward the Y-axis direction.

Therefore, according to the patch antenna apparatus of the preferred example, there is projected radio waves of two linear polarizations which cross each other so as to be perpendicular to each other, where the radio waves include the linear polarization parallel to the X-axis and the linear polarization parallel to the Y-axis. In this case, the linear polarization parallel to the X-axis can be maximally projected in the direction of a low elevation angle on the Z-X plane, and the maximum projection direction of the linear polarization parallel to the Y-axis can be inclined from the Z-axis direction toward the Y-axis direction on the Z-Y plane. In the case of suspending the patch antenna apparatus in an up-side down manner, for example, from the ceiling of a rectangular room or the like, a broader projection area can be established. Also, by forming the feeding transmission lines such as microstrip lines or the like and the power distributing and combining circuit on the same dielectric substrate 77 on which the conductor patches 71 to 74 are formed, this leads to reduction in the thickness of the antenna apparatus.

The length in the resonance direction of each of the conductor patches 71 to 74 which resonate in parallel with the X and Y axes may be set to a value of integer times of 0.4 to 0.6 the wavelength.

In the above-mentioned preferred example, the patch antenna apparatus is constituted by using the conductor patches 71 to 74 each having one feeding point. In a manner similar to that of the first preferred embodiment, the patch antenna apparatus may be constituted by using the conductor patch 12 having two feeding points 13 and 14. Consequently, the number of conductor patches can be decreased, and it is effective oil reduction in size of the antenna apparatus.

Although the preferred example is constituted so that the power distributed to the conductor patches 71 to 73 which resonate in parallel with the X-axis and the power distributed to the conductor patch 74 which resonates in parallel with the Y-axis are made different from each other, however, it may be also possible to make the power distributed equally to each other in accordance with the shape of the space to be projected and the projection area.

According to the present invention as described above in detail, the patch antenna apparatus is constituted by using either at least one conductor patch of two feeding points having two linear polarizations which resonate in the directions which cross each other so as to be perpendicular to each other, at least two conductor patches each of one feeding point having linear polarizations which resonate in the directions which cross each other so as to be perpendicular to each other, or a combination of the conductor patches, and then, at least one of the amplitude and phase of the radio signal fed to each feeding point is changed from the other. Consequently, the radio waves of the two linear polarizations which cross each other so as to be perpendicular to each other are projected with a simple structure, and the projection directional pattern is controlled, thereby enabling a desired projection area to be obtained according to the projection space with a simple structure. By the method of controlling the amplitude and phase of the radio signal fed to each feeding point, the following can be obtained.

(a) A projection area broader than that of the prior art can be obtained.

(b) The projection of a wave can be maximized in a direction with a low elevation angle.

(c) A higher gain and a narrower projection beam than those of the prior art can be obtained.

Although the present invention has been fully described in connection with the present preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A patch antenna apparatus comprising:

a dielectric substrate having a first axis and a second axis which cross each other perpendicularly, and having a first surface and a second surface which are parallel to each other;

a grounding conductor formed on the first surface;

at least one conductor patch formed on the second surface, each said conductor patch having only two feeding points including a first feeding point, for producing resonance in parallel to the first axis at a predetermined resonance frequency, and a second feeding point, for producing resonance in parallel to the second axis at the resonance frequency; and a controller operable to change a shape of a projection area of the patch antenna apparatus to a desired projection area by controlling each of radio signals of the resonance frequency fed to the first and second feeding points, so as to change at least one of an amplitude and a phase thereof, in such a manner that upon feeding the radio signals of the resonance frequency to the first and second feeding points, radio waves project with two linear polarizations which are parallel to the first and second axes, and which cross each other perpendicularly, and with a projection directional pattern corresponding to the desired projection area.

2. The patch antenna apparatus as claimed in claim 1, comprising at least two said conductor patches, two conductor patches selected from said at least two conductor patches being arranged so as to be symmetrical to each other with respect to the first axis, wherein said controller is operable to control the radio signals so as to feed the radio signals having the same phases to only one of said feeding points on each of said two conductor patches.

3. The patch antenna apparatus as claimed in claim 1, comprising at least four said conductor patches, arranged in pairs of conductor patches that are symmetrical to each other with respect to the first axis, wherein said controller is operable to control the radio signals so as to feed the radio signals having phases different from each other to only one of said feeding points on each pair of said conductor patches.

4. The patch antenna apparatus as claimed in claim 1, wherein one of two resonance ends of each of said conductor patches is electrically connected to said grounding conductor, and wherein a length in the resonance direction of each of said conductor patches is set to a value of integer times of a quarter of a wavelength that is based on a dielectric constant of said dielectric substrate.

5. The patch antenna apparatus as claimed in claim 1, wherein a length in the resonance direction of each of said conductor patches is set to a value of integer times of half a wavelength that is based on a dielectric constant of said dielectric substrate.

6. The patch antenna apparatus as claimed in claim 1, wherein each of said conductor patches has a square shape.

7. The patch antenna apparatus as claimed in claim 1, wherein each of said conductor patches has a rectangular shape.

8. The patch antenna apparatus as claimed in claim 1, wherein each of said conductor patches has a circular shape.

9. A patch antenna apparatus comprising:

a dielectric substrate having a first axis and a second axis which cross each other perpendicularly, and having a first surface and a second surface which are parallel to each other;

a grounding conductor formed on the first surface;

at least one first conductor patch formed on the second surface, each said first conductor patch having only one feeding point, said only one feeding point of said each first conductor patch being operable to produce resonance in parallel to the first axis at a predetermined resonance frequency;

at least one second conductor patch formed on the second surface, each said second conductor patch having only one feeding point, said only one feeding point of said each second conductor patch being operable to produce resonance in parallel to the second axis at the resonance frequency; and a controller operable to change a shape of a projection area of the patch antenna apparatus to a desired projection area by controlling each of radio signals of the resonance frequency fed to the feeding points of said at least one first and second conductor patches, so as to change at least one of an amplitude and a phase thereof, in such a manner that upon feeding the radio signals of the resonance frequency to the feeding points of said at least one first and second conductor patches, radio waves project with two linear polarizations which are parallel to the first and second axes, and which cross each other perpendicularly, and with a projection directional pattern corresponding to the desired projection area.

10. The patch antenna apparatus as claimed in claim 9, comprising at least two said first conductor patches, two first conductor patches selected from said at least two first conductor patches being arranged so as to be symmetrical to each other with respect to the first axis, wherein said controller is operable to control the radio signals so as to feed the radio signals of the same phase to each one feeding point of each of said two first conductor patches.

11. The patch antenna apparatus as claimed in claim 9, comprising at least two said second conductor patches, two second conductor patches selected from said at least two conductor patches being arranged so as to be symmetrical to each other with respect to the first axis, wherein said controller is operable to control the radio signals so as to feed the radio signals of the same phase to each one feeding point of each of said two second conductor patches.

12. The patch antenna apparatus as claimed in claim 9, comprising at least four said first conductor patches, arranged in pairs of conductor patches that are symmetrical to each other with respect to the first axis, wherein said controller is operable to control the radio signals so as to feed the radio signals having phases different from each other to each one feeding point of each said first conductor patch of each pair of said first conductor patches.

13. The patch antenna apparatus as claimed in claim 9, comprising at least four said second conductor patches, arranged in pairs of conductor patches that are symmetrical to each other with respect to the first axis, wherein said controller is operable to control the radio signals so as to feed the radio signals having phases different from each other to each one feeding point of each said second conductor patch of each pair of said second conductor patches.

14. The patch antenna apparatus as claimed in claim 9, wherein a length in the resonance direction of each of said conductor patches is set to a value of integer times of half a wavelength that is based on a dielectric constant of said dielectric substrate.

15. The patch antenna apparatus as claimed in claim 9, wherein one of two resonance ends of each of said conductor patches is electrically connected to said grounding conductor, and wherein a length in the resonance direction of each of said conductor patches is set to a value of integer times of a quarter of a wavelength that is based on a dielectric constant of said dielectric substrate.

16. The patch antenna apparatus as claimed in claim 9, wherein each of said conductor patches has a square shape.

17. The patch antenna apparatus as claimed in claim 9, wherein each of said conductor patches has a rectangular shape.

18. The patch antenna apparatus as claimed in claim 9, wherein each of said conductor patches has a circular shape.

19. A patch antenna apparatus comprising:

a dielectric substrate having a first axis and a second axis which cross each other perpendicularly, and having a first surface and a second surface which are parallel with each other;

a grounding conductor formed on the first surface;

at least one first conductor patch formed on the second surface, each said first conductor patch having only two feeding points including a first feeding point, for producing resonance in parallel to the first axis at a predetermined resonance frequency, and a second feeding point, for producing resonance in parallel to the second axis at the resonance frequency;

at least one second conductor patch formed on the second surface, each said at least one second conductor patch having only one feeding point, said only one feeding point of said each second conductor patch being operable to produce resonance in parallel to the first axis at the resonance frequency;

at least one third conductor patch formed on the second surface, each said third conductor patch having only one feeding point, said only one feeding point of said each third conductor patch being operable to produce resonance in parallel to the second axis at the resonance frequency; and a controller operable to change a shape of a projection area of the patch antenna apparatus to a desired projection area by controlling each of radio signals of the resonance frequency fed to the feeding points of said at least one first, second, and third conductor patches, so as to change at least one of an amplitude and a phase thereof, in such a manner that upon feeding the radio signals of the resonance frequency to the feeding points of said at least one first, second, and third conductor patches, radio waves are projected with two linear polarizations which are parallel to the first and second axes, and which cross each other perpendicularly, and with a projection directional pattern corresponding to the desired projection area.

20. The patch antenna apparatus as claimed in claim 19, wherein a length in the resonance direction of each of said conductor patches is set to a value of integer times of half a wavelength, that is based on a dielectric constant of said dielectric substrate.

21. The patch antenna apparatus as claimed in claim 19, wherein one of two resonance ends of each of said conductor patches is electrically connected to said grounding conductor, and wherein a length in the resonance direction of each of said conductor patches is set to a value of integer times of a quarter of a wavelength that is based on a dielectric constant of said dielectric substrate.

22. The patch antenna apparatus as claimed in claim 19, wherein each of said conductor patches has a square shape.

23. The patch antenna apparatus as claimed in claim 19, wherein each of said conductor patches has a rectangular shape.

24. The patch antenna apparatus as claimed in claim wherein each of said conductor patches has a circular shape.

* * * * *